US008150303B2

(12) United States Patent
Kim et al.

(10) Patent No.: US 8,150,303 B2
(45) Date of Patent: Apr. 3, 2012

(54) ADJUSTABLE COMPRESSION UNIT FOR AN IMAGE FIXING APPARATUS

(75) Inventors: Jin-yoon Kim, Suwon-si (KR); Young-min Yoon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 936 days.

(21) Appl. No.: 11/591,601

(22) Filed: Nov. 2, 2006

(65) Prior Publication Data

US 2007/0110487 A1 May 17, 2007

(30) Foreign Application Priority Data

Nov. 14, 2005 (KR) ..... 10-2005-0108751
Dec. 12, 2005 (KR) ..... 10-2005-0121613

(51) Int. Cl.
*G03G 15/20* (2006.01)

(52) U.S. Cl. ..... 399/328; 399/330; 399/331

(58) Field of Classification Search ..... 399/328, 399/330–331
See application file for complete search history.

(56) References Cited

U.S. PATENT DOCUMENTS 3,870,213 A * 3/1975 Meylan ..... 225/100
4,163,892 A * 8/1979 Komatsu et al. ..... 219/216
4,315,682 A * 2/1982 Parzanici ..... 399/322
4,682,878 A * 7/1987 Takizawa et al. ..... 399/122
5,255,060 A * 10/1993 Chikano ..... 399/331
5,436,711 A * 7/1995 Hauser ..... 399/328
5,483,331 A * 1/1996 Wayman et al. ..... 399/330
5,614,999 A * 3/1997 Kanesawa et al. ..... 399/329
5,893,019 A * 4/1999 Yoda et al. ..... 399/321
5,956,547 A * 9/1999 Kamei et al. ..... 399/122
5,987,294 A * 11/1999 Yoda et al. ..... 399/328
5,998,761 A 12/1999 Berkes
6,035,160 A * 3/2000 Kim ..... 399/122
6,105,954 A * 8/2000 Magee et al. ..... 271/10.03
6,201,938 B1 3/2001 Hollar
6,473,592 B2 * 10/2002 Nishio ..... 399/406
6,975,829 B2 * 12/2005 Aruga ..... 399/329
7,016,637 B2 * 3/2006 Senda ..... 399/328
7,020,424 B2 * 3/2006 Gilmore et al. ..... 399/329
7,107,001 B2 * 9/2006 Kameda ..... 399/328
7,251,446 B2 * 7/2007 Yoshida ..... 399/329
7,386,264 B2 * 6/2008 Blair et al. ..... 399/329
7,391,988 B2 * 6/2008 Igarashi et al. ..... 399/101
7,466,952 B2 * 12/2008 Ito et al. ..... 399/329
7,474,869 B2 * 1/2009 Kim et al. ..... 399/322
7,477,858 B2 * 1/2009 Fujii et al. ..... 399/67
7,477,868 B2 * 1/2009 Tomatsu ..... 399/328
7,483,665 B2 * 1/2009 Fujiwara et al. ..... 399/329

(Continued)

FOREIGN PATENT DOCUMENTS

JP 63-085777 4/1988

(Continued)

*Primary Examiner* — David Gray
*Assistant Examiner* — Geoffrey Evans
(74) *Attorney, Agent, or Firm* — Roylance, Abrams, Berdo & Goodman, L.L.P.

(57) ABSTRACT

An image fixing apparatus includes a heat roller, and plural pressure rollers, which rotationally contact the surface of the heat roller by a compression unit. The plural pressure rollers are provided in such a manner that the compressive forces thereof may be adjusted. With this construction, the fixability of a toner image is improved and crumples, wrinkles, and wrap jam that may be produced when a toner image is fixed are substantially prevented.

47 Claims, 31 Drawing Sheets

U.S. PATENT DOCUMENTS

| | | | | |
|---|---|---|---|---|
| 7,697,884 | B2 * | 4/2010 | Tateishi | 399/406 |
| 7,706,707 | B2 * | 4/2010 | Minakuchi et al. | 399/67 |
| 7,877,051 | B2 * | 1/2011 | Ahn | 399/328 |
| 8,014,712 | B2 * | 9/2011 | Lee et al. | 399/331 |
| 8,073,375 | B2 * | 12/2011 | Hiraoka et al. | 399/329 |
| 2003/0053830 | A1 * | 3/2003 | Hachisuka et al. | 399/329 |
| 2003/0128994 | A1 | 7/2003 | Holubek | |
| 2004/0190956 | A1 * | 9/2004 | Senda | 399/328 |
| 2004/0228665 | A1 * | 11/2004 | Tomatsu | 399/322 |
| 2004/0234290 | A1 * | 11/2004 | Tomatsu | 399/67 |
| 2005/0214043 | A1 * | 9/2005 | Kameda | 399/328 |
| 2006/0093395 | A1 * | 5/2006 | Igarashi et al. | 399/101 |
| 2007/0020003 | A1 * | 1/2007 | Kang et al. | 399/328 |
| 2007/0025783 | A1 * | 2/2007 | Jang et al. | 399/328 |
| 2007/0110490 | A1 * | 5/2007 | Tateishi | 399/406 |
| 2007/0212094 | A1 * | 9/2007 | Asakura et al. | 399/69 |
| 2007/0217837 | A1 * | 9/2007 | Yamana et al. | 399/328 |
| 2007/0217838 | A1 * | 9/2007 | Yamana et al. | 399/328 |
| 2008/0267650 | A1 * | 10/2008 | Kim | 399/68 |
| 2008/0310894 | A1 * | 12/2008 | Ahn | 399/328 |
| 2009/0003901 | A1 * | 1/2009 | Lee et al. | 399/331 |
| 2009/0035033 | A1 * | 2/2009 | Chang | 399/328 |
| 2009/0129834 | A1 * | 5/2009 | Ito et al. | 399/328 |
| 2010/0158588 | A1 * | 6/2010 | Kim et al. | 399/331 |
| 2011/0142496 | A1 * | 6/2011 | Kameda | 399/122 |

FOREIGN PATENT DOCUMENTS

| | | | |
|---|---|---|---|
| JP | 02-163783 | | 6/1990 |
| JP | 040063388 | | 2/1992 |
| JP | 04-125581 | | 4/1992 |
| JP | 05204276 | A * | 8/1993 |
| JP | 10-171283 | | 6/1998 |
| JP | 10-240044 | | 9/1998 |
| JP | 2000-198572 | | 7/2000 |
| JP | 2000-214718 | | 8/2000 |
| JP | 2002-139948 | | 5/2002 |
| JP | 2005-140994 | | 6/2005 |
| JP | 2007-025541 | | 2/2007 |

* cited by examiner

ADJUSTABLE COMPRESSION UNIT FOR AN IMAGE FIXING APPARATUS

CROSS-REFERENCE TO RELATED APPLICATIONS

This application claims the benefit under 35 §119(a) of Korean Patent Application Nos. 2005-108751 and 2005-121613, filed on Nov. 14, 2005 and Dec. 12, 2005, respectively, in the Korean Intellectual Property Office, the entire disclosures of both of which are hereby incorporated by reference.

BACKGROUND OF THE INVENTION

1. Field of the Invention

The present invention relates to an image fixing apparatus for fixing a toner image to a record medium and a method of controlling the same.

2. Description of the Related Art

As is well-known in the art, an electrophotographic image forming apparatus, such as a laser beam printer, an LED printer, a digital copying machine, a facsimile and the like, is an appliance for transferring image signals to a record medium as a visual image according to digital signals inputted from a computer or a scanner.

Specifically referring to the operation of such an image forming apparatus, image signals form an image on a photoconductor medium in a form of an electrostatic latent image. The electrostatic latent image formed on the photoconductor medium is visualized as a visual image by toner. The visual image is transferred to a record medium, such as print paper, OHP (overhead projection) film, envelopes, and the like. Then, as the record medium to which the visual image is transferred passes an image fixing apparatus, the visual image is fixed to the record medium, which is in turn discharged out of the image forming apparatus.

Meanwhile, because the toner image that is transferred to the record medium is deposited to the record medium by a weak electrostatic force, it is apt to scatter. The image fixing apparatus is means for applying predetermined heat and pressure to the record medium to which a toner image is transferred, thereby melting and fusing the toner of the image to the record medium. The image, which has been subjected to such an image fixing process, can be substantially permanently preserved.

Generally, the above-mentioned image fixing apparatus includes a heat roller provided with a heat source, such as a heat lamp, in the inside thereof to transfer the heat generated from the heat source to a record medium, and a pressure roller for compressing the record medium against the heat roller. The heat roller has a cylindrical surface formed of a metallic material on which surface a Teflon resin is coated. The pressure roller has a surface formed of a soft material, such as rubber or the like, and compresses the record medium through compression means, such as springs, which are mounted at the opposite ends of the pressure roller.

Such an image fixing apparatus should meet the following requirements:

i) the fixing of an image shall be easily executed within a proper range of temperature of the heat generated from the heat roller; and ii) a wrap jam phenomenon, which causes a toner image on a record medium to be deposited to the heat roller as the record medium is curled under the influence of the heat from the heat roller, and wrinkles, crumples or the like of the record medium, which may be produced as the record medium is heated, shall be minimized.

In many cases, however, the above-mentioned requirements may be in conflict with each other. For example, if the temperature of the heat roller is increased to enhance the fixability of a toner image, a record medium is adhered to the heat roller, whereby wrap jam, wrinkles, crumples, and so forth, are frequently produced. To the contrary, if the temperature of the heat roller is reduced, the fixability of the toner image is deteriorated. Additionally, if the compressive force of the pressure roller for compressing the record medium against the heat roller is increased, the length of time of transferring heat from the heat roller to the record medium is also increased, whereby the fixability of the toner image may be enhanced. However, the endurance of the pressure roller may be deteriorated.

Recently, to efficiently prevent wrap jam and to improve the fixability of toner images in an image fixing apparatuses having features that are in conflict with each other as described above, an arrangement in which plural pressure rollers come into rotational contact with a heat roller, has been widely adopted.

FIG. 1 shows an image fixing apparatus with such an arrangement employing a pair of pressure rollers, by way of an example, wherein the image fixing apparatus includes a heat roller 10 having a heat source 11 within the inside thereof. First and second pressure rollers 21 and 22 rotationally contact the surface of the heat roller 10.

The heat roller 10 is coated with a sheath 12 of a resilient material over the peripheral surface thereof. For example, the sheath 12 may be formed from a silicon polymer, an elastomer or the like. The sheath 12 may be coated with a Teflon coating layer, so that a toner image can be more easily released.

The first and second pressure rollers 21 and 22 are mounted in such a manner as to be rotatable about rotary shafts 21*a* and 22*a*, respectively. Each of the opposite ends of the rotary shafts 21*a* and 21*b* is rotatably supported by a bushing member 26, which is in turn biased toward the heat roller by compression means 25, such as a coil spring.

The sheath of the second pressure roller 22 is formed from a material that is harder than the sheath 12 of the heat roller 10, so that the sheath 12 of the heat roller 10 is deformed at the area where the heat roller 10 and the second pressure roller 22 rotationally contact each other. The peripheral surface of the first pressure roller 21 is formed from a material that is softer than the sheath 12 of the heat roller 10, so that the first pressure roller 21 is deformed at the area where the heat roller 10 and the first pressure roller 21 rotationally contact each other.

A first image fixing nip is created at the area where the heat roller 10 and the first pressure roller 21 rotationally contact each other, and a second image fixing nip is created at the area where the heat roller 10 and the second pressure roller 22 rotationally contact each other.

After an image is fixed to a record medium P at the first and second nips by the heat roller 10 and the first and second pressure rollers 21 and 22 and the record medium P is curled over the heat roller 10 at the first nip under the influence of the heat of the heat roller 10, the record medium P is compressed in the opposite direction at the second image fixing nip by the second pressure roller 22, whereby the record medium P is discharged in a gently flattened state. That is, the record medium P with an image being fixed is curled in the direction opposite to the heat roller 10 by the compressive force applied by the second pressure roller 22, whereby the record medium P is discharged in the flattened state through the image fixing apparatus by the reverse curling.

Additionally, although the toner image on the record medium P may be deposited to the heat roller 10 side by the first pressure roller 21 of the soft material while the record medium is passing the first image fixing nip, the toner image may be smoothly released from the sheath 12 of the heat roller 10 because the sheath 12 of the heat roller 10 is abruptly deformed due to the hard characteristic of material of the second pressure roller 22, as well as because the record medium P is reversely curled by the compressive force applied by the second pressure roller 22 while the record medium P is passing the second image fixing nip, whereby the wrap jam phenomenon is prevented.

As described above, an image fixing apparatus, which employs plural pressure rollers, has advantages of not only improving the fixability of a toner image due to the increase of the compressive forces of the pressure rollers, but also preventing wrap jam, crumples, and wrinkles.

However, the above-mentioned prior art has a limit in that because the magnitudes and/or the directions of the compressive forces to be applied by the first and second pressure rollers 21 and 22 are specified and fixed in such a manner as to be suitable for ordinary print papers, it is extremely difficult to properly cope with parameters of a certain record medium (for example, thickness, quality of material, and any other characteristic of the record medium), density of a toner image to be deposited to the record medium, or the like.

Accordingly, a need exists for an image fixing apparatus having a compression unit in which the compressive forces applied by a plurality of pressure rollers are adjustable.

SUMMARY OF THE INVENTION

An object of the present invention is to provide an image fixing apparatus and a method of controlling the same, which adjust the compressive forces of plural pressure rollers of the image fixing apparatus according to one or more parameters of a record medium and/or density of a toner image, thereby improving the fixability of the toner image.

Another object of the present invention is to provide an image fixing apparatus and a method of controlling the same that improves the fixability of a toner image but also substantially prevents curl, wrinkles, wrap jam and the like of a record medium that may be produced when fixing a toner image.

An image fixing apparatus according to an exemplary embodiment of the present invention includes a heat roller, a plurality of pressure rollers that rotationally contact the surface of the heat roller, and a compression unit for compressing the plurality of pressure rollers against the heat roller. The compressive forces for compressing the plural pressure rollers are adjustable.

The compression unit may include at least one compression portion for compressing the plural pressure rollers; and at least one support member for supporting the compression portion.

The compression unit may further include at least one bushing member for rotatably supporting the plurality of pressure rollers.

The compression unit may further include an actuator for driving the bushing member and/or the support member.

Preferably, the compressive forces applied by the compression portion are evenly distributed over the plurality of pressure rollers.

The compression portion may include at least one spring for applying the compressive forces to the plural pressure rollers.

The image fixing apparatus includes plural compression portions that correspond to the plurality of pressure rollers.

Preferably, each number of compression portions is provided to the respective pressure roller.

Each of the compression portions may include at least one spring.

The plurality of compression portions may have different elastic coefficients.

The plurality of compression portions may have different lengths.

The support member may be movably provided, so that the distance between the heat roller and the support member is adjustable.

The support member may be guided along a guide path.

The support member may be pivotally provided.

The bushing member may be pivotally provided.

The support member may be pivotally and movably provided, so that the distance between the heat roller and the support member is adjustable.

Additionally, an image fixing apparatus according to an exemplary embodiment of the present invention includes a heat roller having a heat source within the inside thereof, a plurality of pressure rollers that rotationally contact the surface of the heat roller, and means for adjusting the relative compressive forces of the plurality of pressure rollers.

The compressive force adjusting portions may include a bushing member for rotationally supporting the respective compression rollers, a support member located at a distance from the bushing member, and a plurality of compression means resiliently disposed between the bushing member and the support member to resiliently compress the respective pressure rollers.

The support member may be pivotally provided.

The image fixing apparatus may further include pivot means for pivoting the support member.

The pivot means may include a lever that rotationally contacts one side of the support member on which plural control surfaces are formed. The support member is pivoted by the swivel movement of the lever, thereby adjusting the compressive force of the compression means.

The pivot means may include a cam member that rotationally contacts one side of the support member, and a driving unit for rotating the cam member.

The driving unit may include a clutch for separably connecting a cam shaft of the cam member to a driving source, a solenoid provided in the outside of the clutch to adjust the rotating state of the cam shaft, and control means for controlling the operation of the solenoid.

The control means may be inputted with one or more parameters of a record medium and operated according to the parameters.

The control means may be connected to a paper detection sensor for detecting one or more parameters of a record medium and/or a density detection sensor for detecting density of an image.

According to another aspect of the present invention, a method of controlling an image fixing apparatus includes the steps of outputting information of one or more parameters of a record medium and/or density of a toner image, determining an image fixing condition corresponding to the outputted information, and performing the image fixing operation after adjusting at least one of the total sum or relative ratio of the compressive forces applied to the plural pressure rollers according to the determined image fixing condition.

The image fixing condition determining step may include steps of judging whether a previously inputted image fixing condition exists or not, and determining the image fixing condition on the basis of the information outputted in the information outputting step unless the previously inputted image fixing condition exists. The image fixing condition newly determined is substituted on the basis of the information outputted in the information outputting step for the previously inputted image fixing condition when the previously inputted image fixing condition exists.

The image fixing step may include the step of adjusting the relative ratio of the compressive forces applied to the plural pressure rollers by pivoting the support member and/or the bushing member.

The image fixing step may further include the step of adjusting the total sum of the compressive forces applied to the plural pressure rollers by moving the support member so that the distance between the support member and the heat roller is adjusted.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above aspects and features of the present invention will be more apparent from the description for certain exemplary embodiments of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Hereinbelow, exemplary embodiments of the present invention are described in detail with reference to accompanying drawings. In the following description, a detailed description of known functions and configurations incorporated herein are omitted to provide a clear and concise specification.

Figure 1:
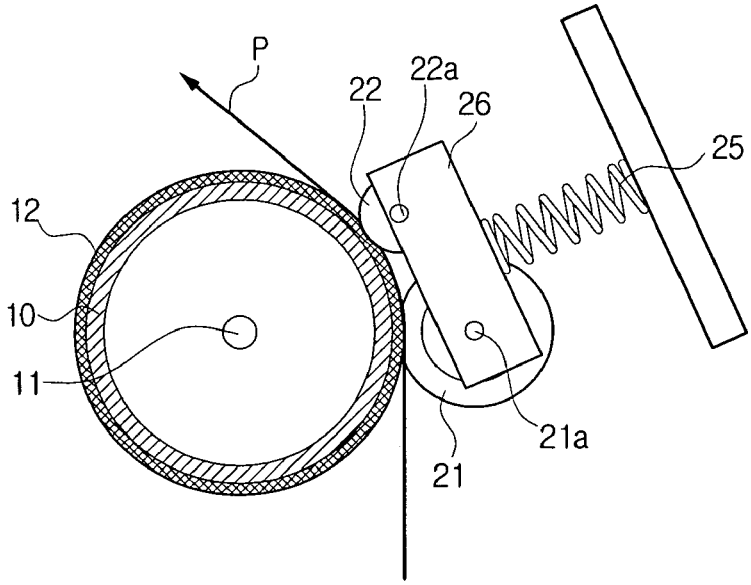
FIG. 1 (PRIOR ART)
FIG. 1 is an elevational view of an image fixing apparatus according to the prior art.
Figure 2:
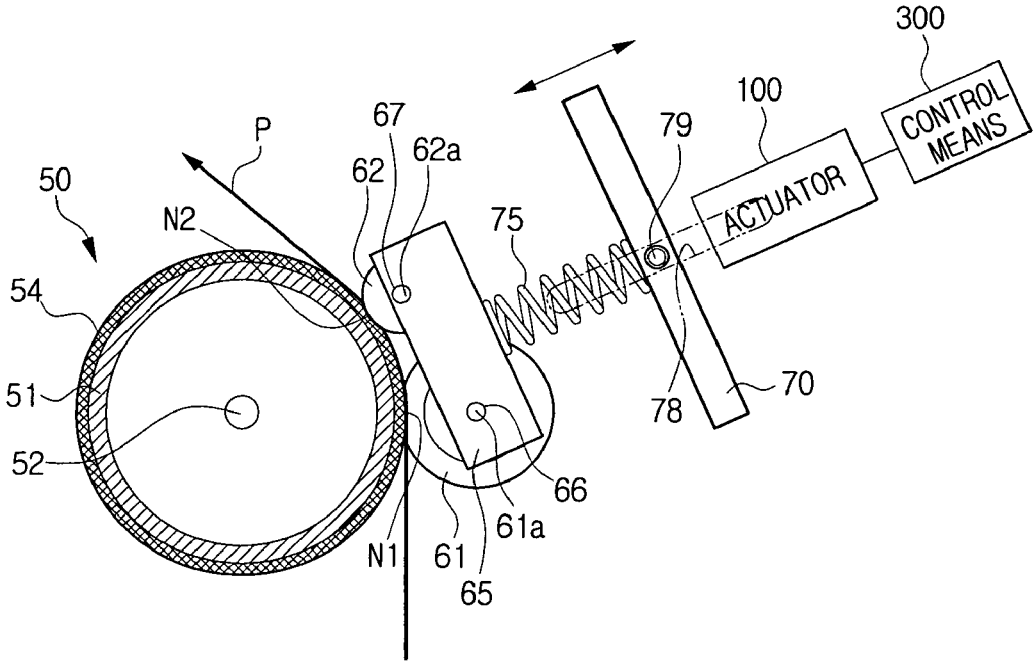
FIG. 2 is an elevational view of an image fixing apparatus according to a first exemplary embodiment of the present invention, wherein various actuators and related arrangements thereof that may be employed in the image fixing apparatus are shown in FIGS. 2A to 2G.

FIG. 2 conceptually shows an image fixing apparatus according to a first exemplary embodiment of the present invention.

As shown in FIG. 2, the image fixing apparatus includes a heat roller 50 for transferring heat to a record medium P to fix a toner image to the record medium P, and pressure rollers 61 and 62 for compressing the record medium against the heat roller 50.

The heat roller 50 has a substantially cylindrical rotary body 51, which is formed of a metallic material, such as aluminum, that is superior in heat conductivity, and mounted in such a way as to be capable of being rotated by a driving source, such as a driving motor.

A heat source 52, such as a halogen lamp, is provided within the rotary body 51, and a sheath 54 is provided around the peripheral surface of the rotary body 51. The sheath 54 is formed of a resilient material, such as silicon polymer, elastomer or the like, and is coated, with Teflon for example, on the peripheral surface of the sheath 54 so that a toner image may be easily released from the sheath 54.

The first and second pressure rollers 61 and 62 come into rotational contact with the sheath 54 of the heat roller 50, and respective rotary shafts 61*a* and 62*a* of the first and second pressure rollers 61 and 62 are rotatably supported by bushing members 65 at the opposite ends thereof.

A first image fixing nip N1 is formed at the area where the heat roller 50 and the first pressure roller 61 rotationally contact each other, and a second image fixing nip N2 is formed at the area where the heat roller 50 and the second pressure roller 62 rotationally contact each other.

One pair of the bushing members 65 have support holes 66 and 67 for rotatably supporting the opposite ends of the rotary shafts 61*a* and 62*a* of the first and second pressure rollers 61 and 62, respectively, wherein a bearing may be provided within each of the support holes 66 and 67 so as to support the rotary shafts 61*a* and 62*a* in such a manner as to be smoothly rotatable. The one pair of bushing members 65 may me integrally formed.

One pair of support members 70 are arranged at a predetermined distance from the respective bushing members 65, and compression portions 75 are resiliently interposed between the bushing members 65 and the support members 70. The one pair of the support members 70 may be integrally formed.

As appreciated, one side of the rotary shafts 61*a* and 61*b* may be provided with one bushing member 65, one support member 70, and one compression portion 75, which are same with those provided at the other side of the rotary shafts 61*a* and 62*a*. As such, for these components, description will occasionally be made in terms of those provided at one side of the rotary shafts 61*a* and 62*a* of the pressure rollers 61 and 62 for the convenience of description and for the purpose of easy understanding. However, the description of these components and other related constructions will be applicable to those provided at the other side of the rotary shafts 61*a* and 61*b*, unless specifically described.

Preferably, compression portion 75 may include at least one spring for compressing the pressure rollers 61 and 62 against the heat roller 50. The compression portion 75 of the present exemplary embodiment evenly distributes and applies compressive forces to the pressure rollers 61 and 62. Additionally, the support member 70 is provided in such a way as to be movable in relation to a frame (not shown) of an image fixing apparatus.

The arrangement concerning movement of the support member 70 includes at least one guide groove 78, which is formed on the frame of the image fixing apparatus, and at least one guide projection 79, which protrudes from the support members 70 to correspond to the guide groove 78, wherein the movement of the support members 70 is guided as the guide projection 79 is guided along the guide groove 78.

Figure 2A:
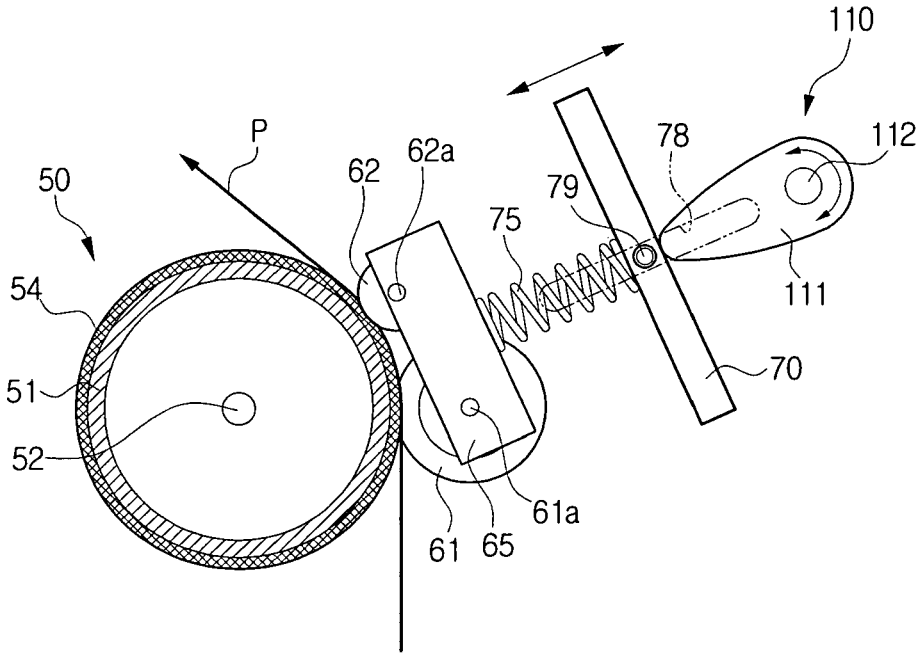
Figure 2B:
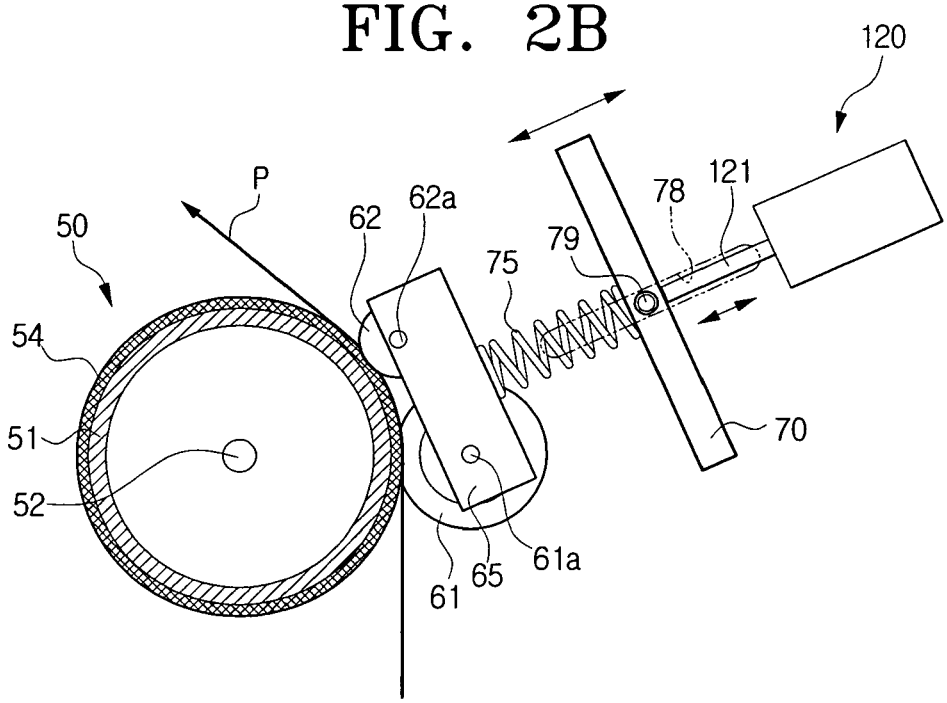
Figure 2C:
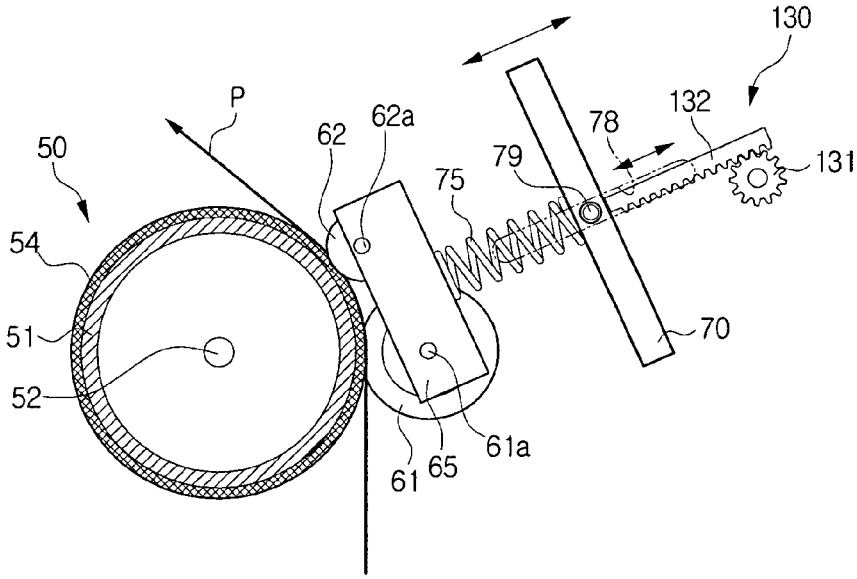
Figure 2D:
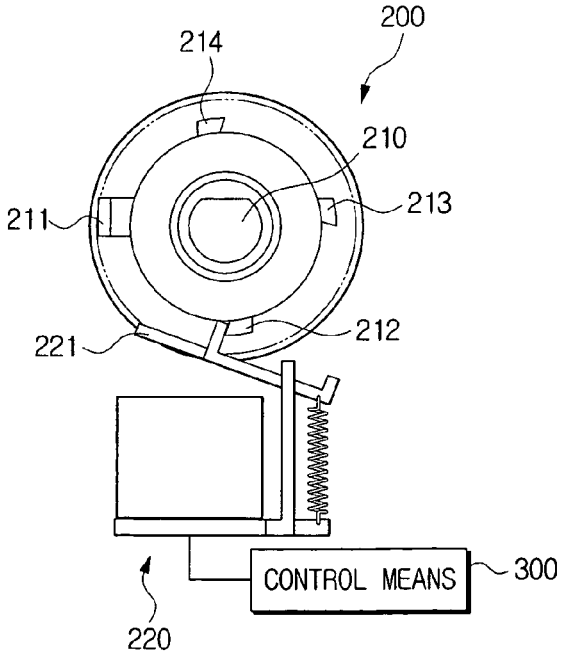
Figure 2E:
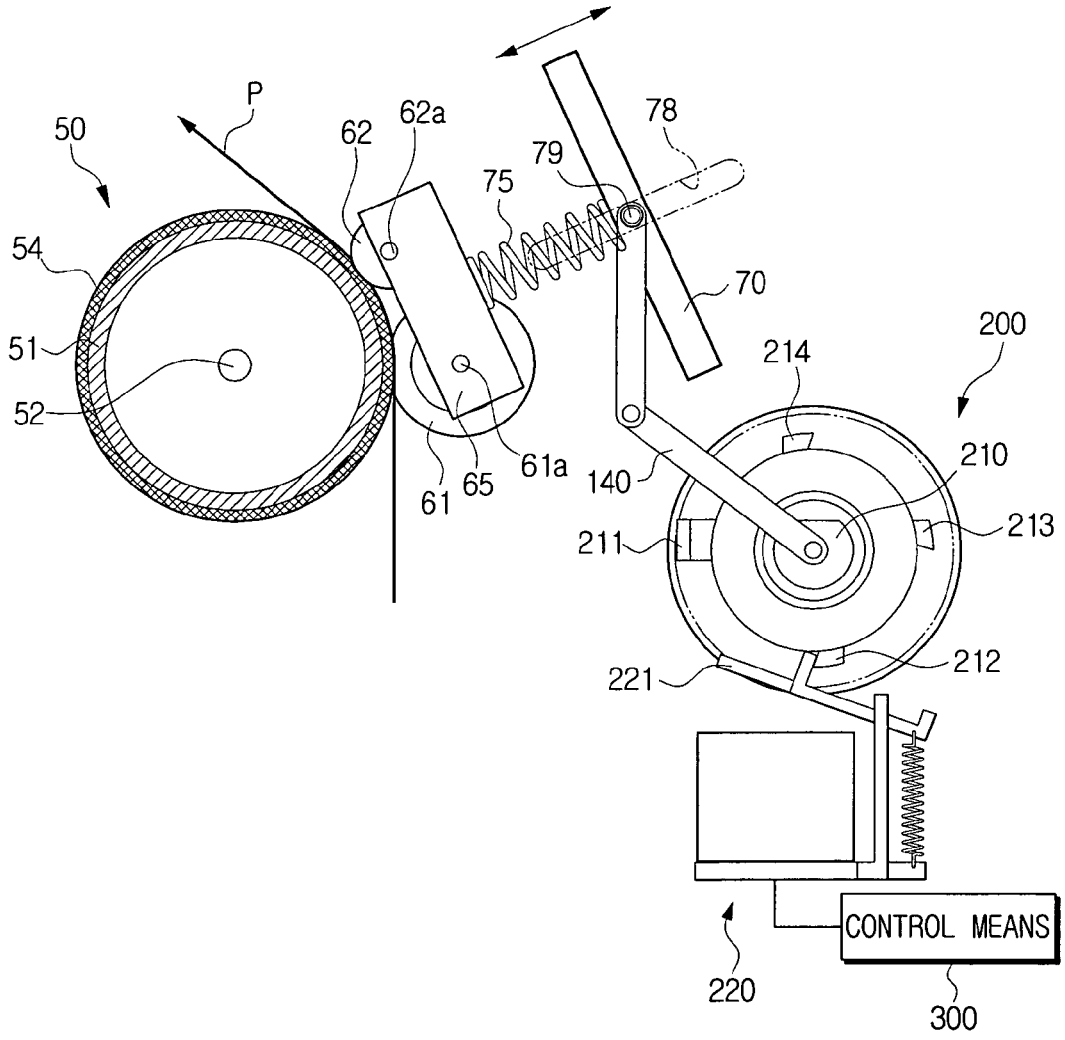
Figure 2F:
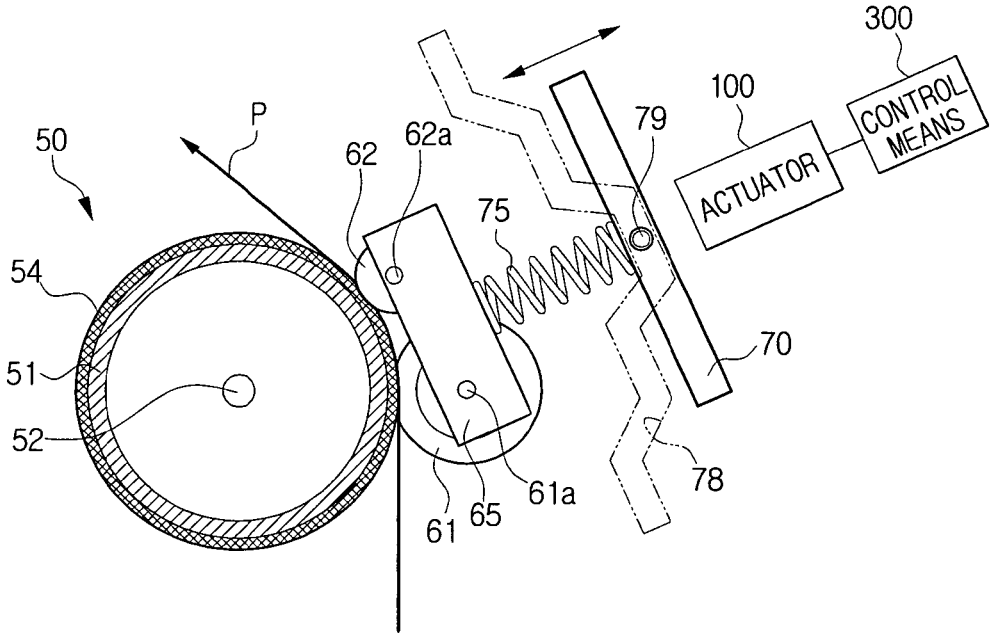
Figure 2G:
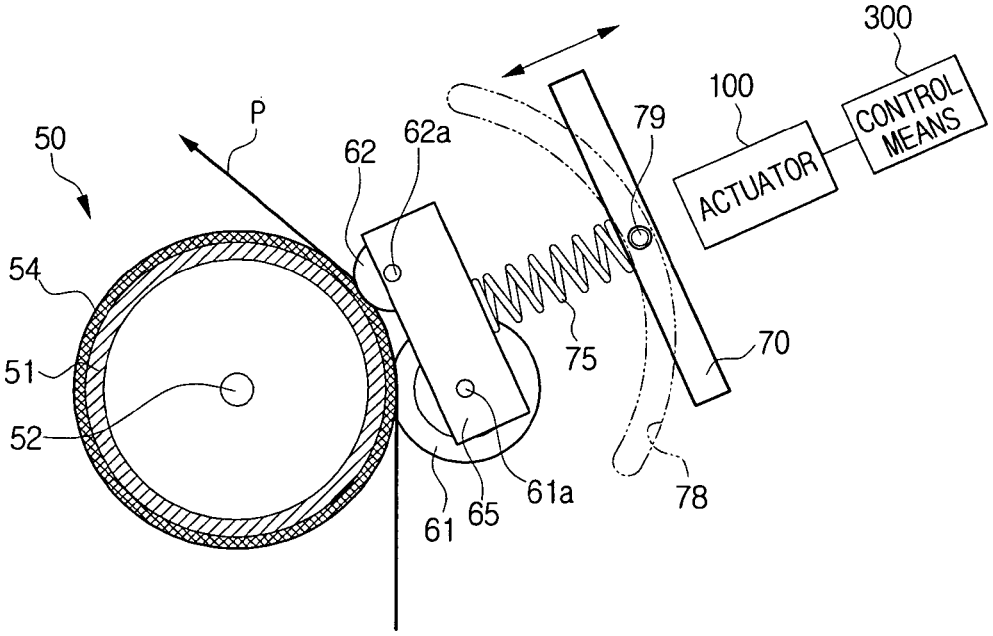

The above-mentioned guide groove 78 may be formed in a subtantially linear shape as shown in FIGS. 2 to 2E or in a substantially circular arc or step shape as shown in FIGS. 2F and 2G.

That is, the guide groove 78 may take any shape if the distance between the heat roller 50 and the support member 70 may be adjusted as the support member 70 moves along the guide groove 78, wherein the support member 70 is stopped at a moved position by a stopper (not shown) or the like when it moves along the guide groove 78.

The first exemplary embodiment is technically characterized by the fact that the total sum of the compressive forces applied to the plural pressure rollers 61 and 62 may be adjusted as the distance between the support member 70 and the heat roller 50 is adjusted.

The present exemplary embodiment includes an actuator 100 for adjusting the distance between the support member 70 and the heat roller 50, wherein the actuator 100 may be configured to be manually controllable like a lever mechanism, a cam mechanism, a gear transmission mechanism or the like, or to be electronically controllable using control means. The operation of the electronically controllable actuator 100 is controlled by the control means 300.

Preferably, the control means 300 is connected to a control board of an image forming apparatus or a personal computer (PC), in such a way that when a user properly selects one or more parameters of a record medium (thickness, size, quality of material, and so forth) and/or density of an image on the control board of the image forming apparatus or the PC, the control means 300 controls the actuator 100 on the basis of the selected information.

Alternatively, the control means 300 may be connected to a detection sensor (not shown) for detecting the parameters of a record medium (thickness, size, quality of material, and so forth), so that the control means controls the actuator 100 on the basis of detection signals of the detection sensor.

Various electronically controllable actuators 100 are shown in FIGS. 2A to 2E.

FIG. 2A shows a first specific form of an actuator 100, which employs a cam mechanism 110, wherein the cam mechanism 110 compresses and moves the outer surface of the support member 70 so that the distance between the support member 70 and the heat roller 50 is adjusted, whereby the total compressive forces applied to the pressure rollers 61 and 62 may be adjusted.

The cam mechanism 110 includes a cam member 111 for compressing the outer surface of the support member 70 to rectilinearly move the support member 70 toward the heat roller 50, and a rotary shaft 112 for rotating the cam member 111, which may be provided in such a way to cooperate with any of various driving motors (not shown) for the image fixing apparatus or the image forming apparatus.

Additionally, various forms of control surfaces (not shown) may be formed on the outer surface of the support member 70 to facilitate the rectilinear reciprocating movement of the support member 70.

Alternatively, the rotary shaft 112 may cooperate with a driving unit, which is shown in FIG. 2D by way of an example. Such a driving unit 200 includes a driving shaft 210, which is separably connected to one end of the rotary shaft 112 by a clutch (not shown) or the like, plural phase control projections 211, 212, 213 and 214 formed on the peripheral surface of the driving shaft 210, and a solenoid 220, which is arranged outside of the driving shaft 210 to control the phase control projections 211, 212, 213 and 214 of the driving shaft 210.

The driving shaft 210 may be cooperatively connected to various types of driving motors (not shown) for driving an image transfer roller, a developing roller, and so forth of an image forming apparatus or the heat roller of the image fixing apparatus via a gear train or the like.

The rotational force of the driving shaft 210 is intermittently transmitted to the rotary shaft 112 through the clutch (not shown) or the like.

The phase control projections 211, 212, 213 and 214 project from the peripheral surface of the driving shaft 210, and a movable body 221 of the solenoid 220 is selectively engaged with the respective phase control projections 211, 212, 213 and 214, thereby adjusting the rotating angle of the rotary shaft 112 of the cam mechanism 100, so that the rotating angle of the cam member 111 is adjusted, as a result of which the support member 70 is rectilinearly reciprocated.

The solenoid 220 is electrically connected to the control means 300, so that the movement of the movable body 221 of the solenoid 220 is controlled by the control means 300.

Although the solenoid 220 employed in the driving unit, which is shown in FIG. 2D by way of an example, is an armature type solenoid, the movable body 221 of which is swiveled by an electromagnet and a spring, the present exemplary embodiment is not limited to such a configuration and various types of solenoids, such as plunger type solenoids, latch type solenoids, and the like, are applicable to the present exemplary embodiment.

FIG. 2B shows a second specific form of an actuator 100 that employs a solenoid 120, wherein the movable body 121 of the solenoid 120 compresses the outer surface of the support member 70 to move the support member 70, so that the distance between the support member 70 and the heat roller 50 is adjusted, whereby the compressive force of the compression portion 75 may be adjusted.

The solenoid 120 is electrically connected to the control means 300, and the movable body 121 of the solenoid 120 is moved to and fro by the control means, thereby reciprocating the support members 70 toward and away from the heat roller 50, so that the total sum of compressive forces applied to the pressure rollers 61 and 62 may be adjusted.

Although the solenoid 120 shown in FIG. 2B is a plunger type solenoid, the movable body 121 of which is rectilinearly moved by an electromagnet, the solenoid of the present embodiment is not limited to such a configuration, and various types of solenoids, such as armature types, latch types, and the like, are applicable to the present exemplary embodiment.

FIG. 2C shows a third specific form of an actuator 100, which employs a gear transmission mechanism 130, wherein the gear transmission mechanism 130 includes a rotationally driven pinion 131, and a rack 132 which is meshed with the pinion 131.

The pinion 131 may be cooperatively connected with a driving source (not shown) such as driving rollers for driving the heat roller of the image fixing apparatus or an image transfer roller, a developing roller or the like of the image forming apparatus, through a gear train.

The rack 132 converts the rotating movement of the pinion 131 into a rectilinear movement to compress the outer surface of the support member 70, thereby rectilinearly reciprocating the support member 70 toward and away from the heat roller 50, so that the distance between the support member 70 and the heat roller 50 is adjusted, whereby the compressive forces of the compression portion 75 may be adjusted.

Because the driving source (not shown) connected with the pinion 131 is also connected to the control means 300, the rotational movement of the pinion 131 may be controlled.

Alternatively, the pinion 131 may be arranged in such a manner that its rotary shaft is intermittently connected with the driving shaft 210 of the driving unit 200 shown in FIG. 2D through a clutch or the like, whereby the pinion 131 may be controlled by the driving unit 200.

FIG. 2E shows a fourth specific form of an actuator 100, which employs the driving unit 200 shown in FIG. 2D and a link mechanism 140.

In the fourth specific form, the link mechanism 140 is connected between the driving shaft 210 of the driving unit 200 and the support member 70 to convert the rotational movement of the driving shaft 210 into rectilinear movement and to transmit the rectilinear movement to the support member 70, thereby moving the support member 70 toward or away from the heat roller 50, so that the distance between the support member 70 and the heat roller 50 is adjusted, whereby the total sum of the compressive forces applied to the pressure rollers 61 and 62 may be adjusted.

The actuator 100 applicable to the first exemplary embodiments of the present invention are not limited to the specific forms shown in FIGS. 2A to 2G, and various forms of actuators are applicable that rectilinearly reciprocate the support member 70, like a hydraulic or pneumatic cylinder or a manually operated lever mechanism.

Figure 3:
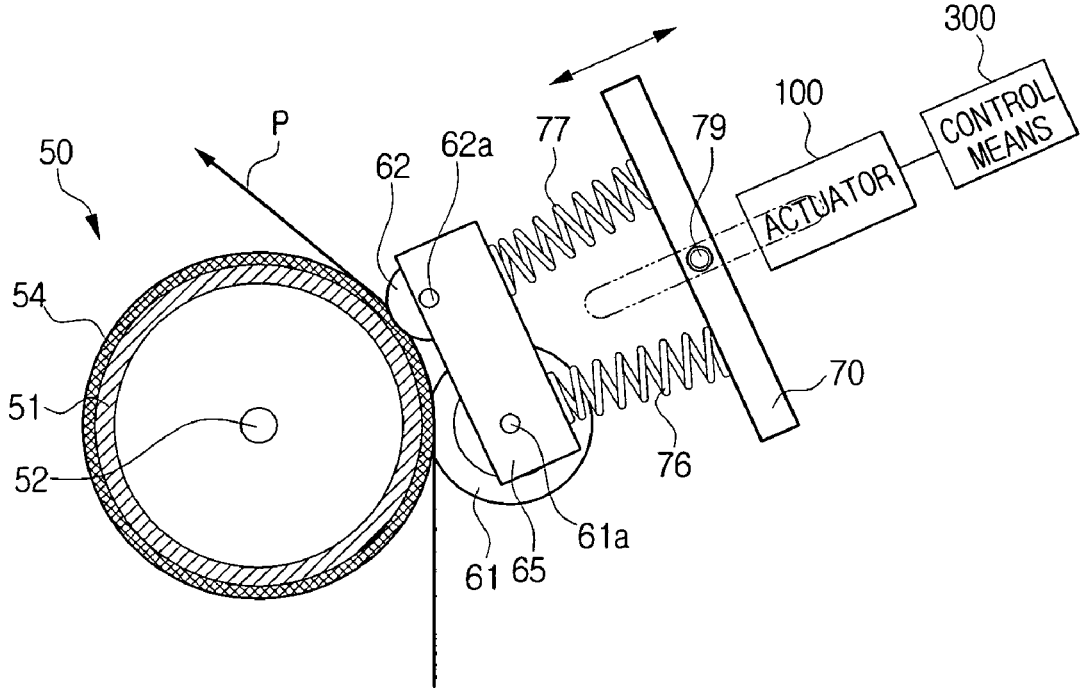
FIG. 3 is an elevational view of an image fixing apparatus according to a second exemplary embodiment of the present invention, wherein various actuators and related arrangements thereof that may be employed in the image fixing apparatus are shown in FIGS. 3A to 3G.
Figure 3A:
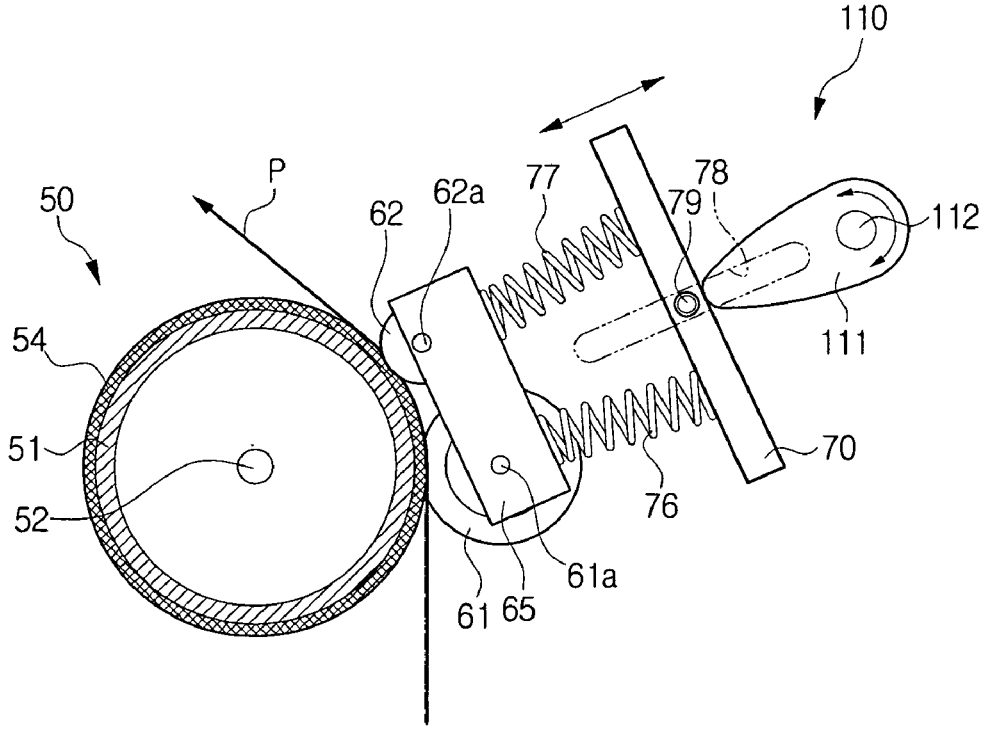
Figure 3B:
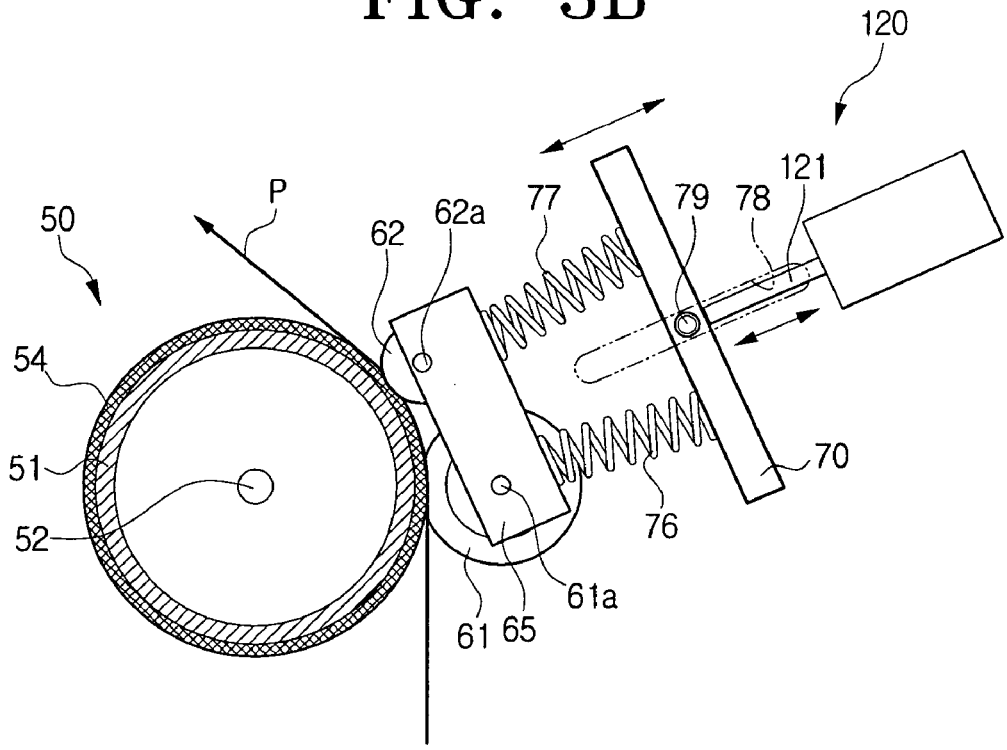
Figure 3C:
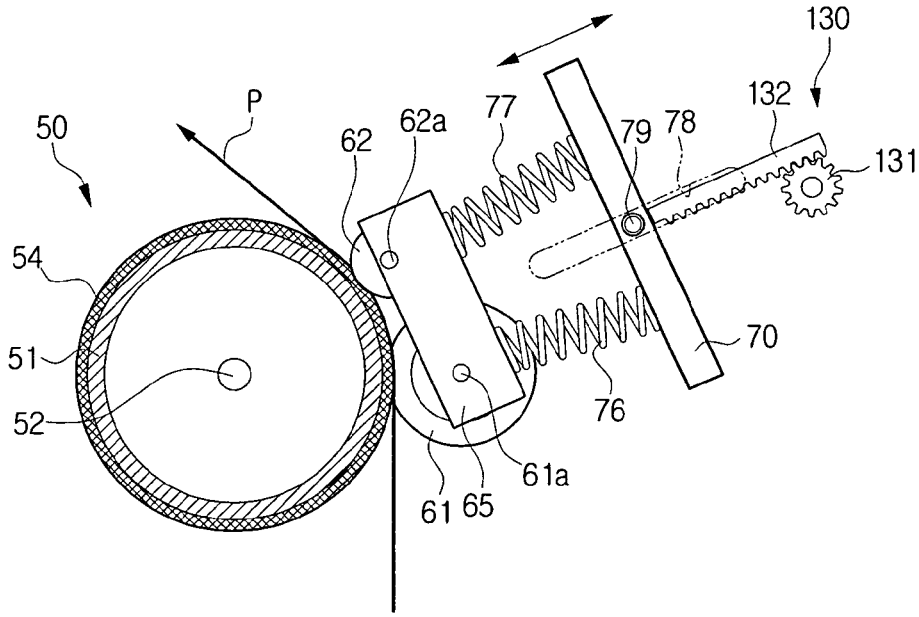
Figure 3D:
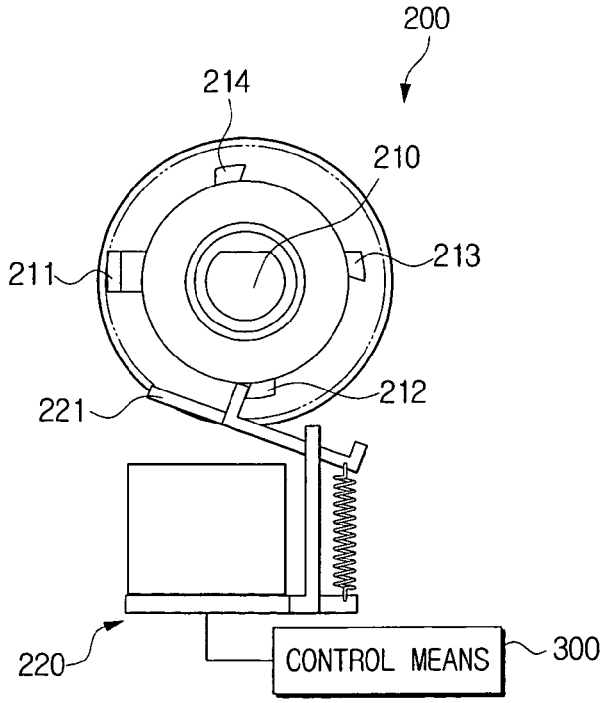
Figure 3E:
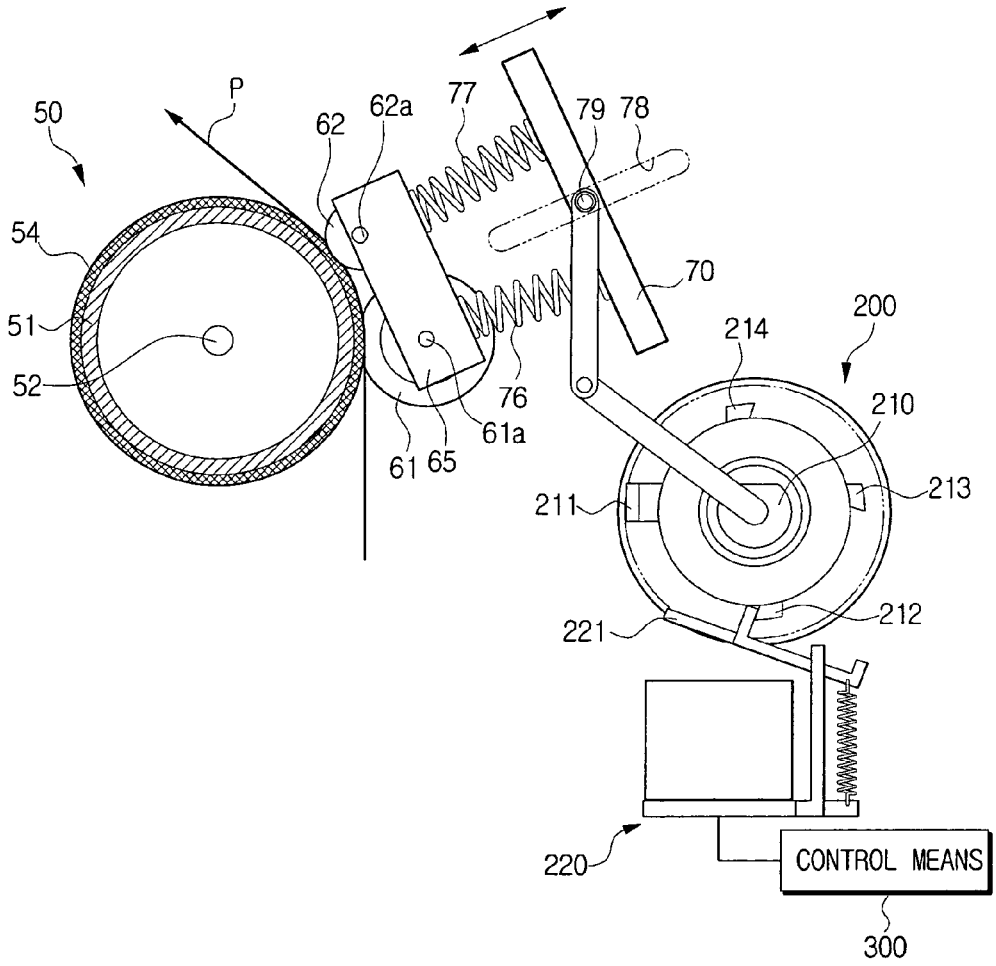
Figure 3F:
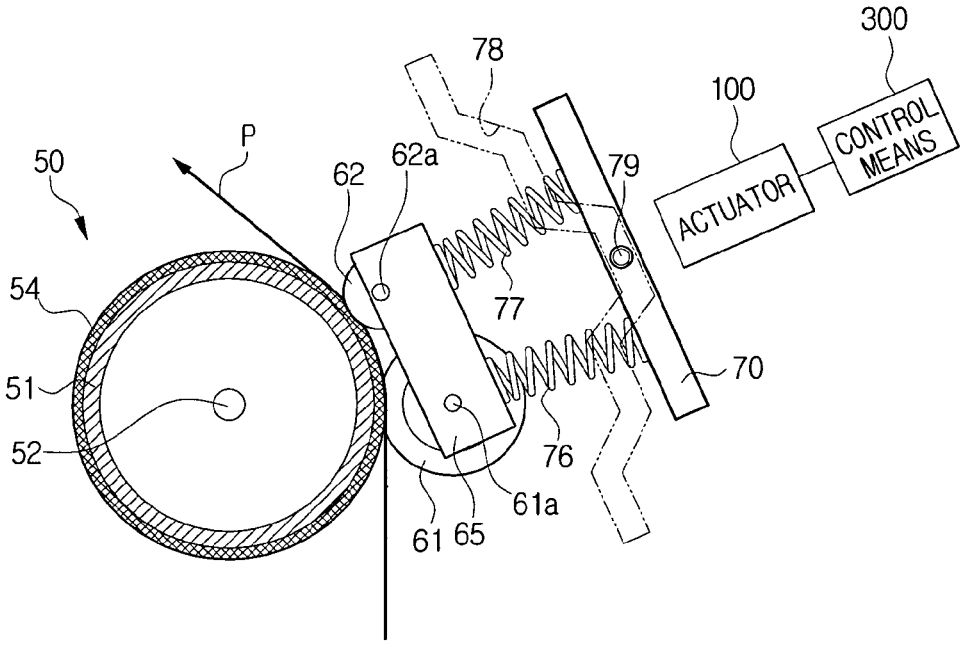

FIG. 3 shows an image fixing apparatus according to a second exemplary embodiment of the present invention. FIGS. 3A to 3G show various specific forms of actuators that are applicable to the second exemplary embodiment.

As shown in the drawings, the image fixing apparatus according to the second exemplary embodiment includes a heat roller 50 for transferring heat to a record medium P to fix a toner image to the record medium P, and plural pressure rollers 61, 62 for compressing the record medium P against the heat roller 50.

While the first exemplary embodiment of the present invention is configured to evenly distribute and provide compressive forces over the plural pressure rollers 61 and 62, the second exemplary embodiment is technically characterized by the fact that it includes plural compression portions for independently applying compressive forces to the pressure rollers 61 and 62, respectively.

In the second exemplary embodiment, the compressing directions of the respective compression portions 76 and 77 are preferably converged to the centers of the respective pressure rollers 61 and 62, whereby the compressive forces applied to the respective pressure rollers 61 and 62 may be equal to or different from each other.

For example, if the plural pressure rollers are composed of two pressure rollers, that is, first and second pressure rollers 61 and 62, the plural compression portions corresponding to the plural pressure rollers are also composed two compression portions, that is, first and second compression portions 76 and 77, wherein the first compression portion 76 independently applies compressive force to the rotary shaft 61*a* of the first pressure roller 61 and the second compression portion 77 independently applies compressive force to the rotary shaft 62*a* of the second pressure roller 62. Additionally, when the number of the pressure rollers is three or more, the number of the compression portion is also three or more, so that each compression portion independently applies compressive force to a corresponding pressure roller.

Figure 3G:
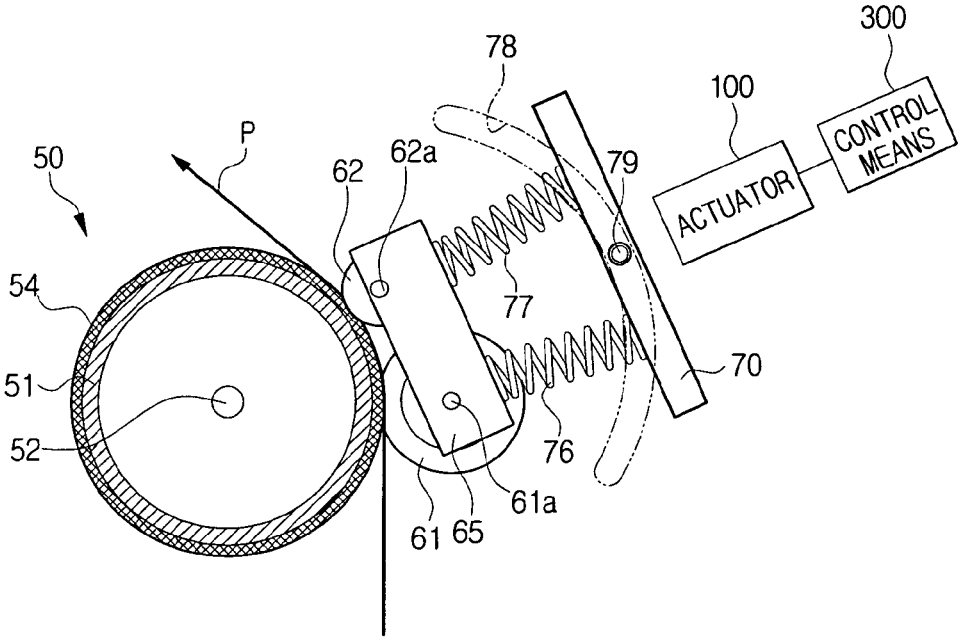

Additionally, although the first compression portion 76 or the second compression portion 77 is shown as being configured in a single spring form as shown in FIGS. 3 to 3G, the second exemplary embodiment of the present invention is not limited to this and each compression portion may be composed of two or more springs. Consequently, the number of the springs constituting the first compression portion 76 may be different from the number of springs constituting the second compression portion 77.

Additionally, the respective springs of the first and second compression portion 76 and 77 may be equal to or different from each other in elastic coefficient and length.

Because the other configuration and operating relationship of the second exemplary embodiments are substantially identical or similar to the first exemplary embodiments shown in FIGS. 2 to 2G, detailed description thereof is omitted.

The image fixing apparatus according to the first and second exemplary embodiments as described above may properly control the total sum of the compressive forces applied to the plural pressure rollers 61 and 62 according to the parameters of a record medium (thickness, size, quality of material, and so forth) to be used or the density of a toner image deposited to the record medium. Consequently, the fixability of the toner image may be enhanced as well as substantially preventing wrap jams, crumples, wrinkles, and the like.

Figure 4:
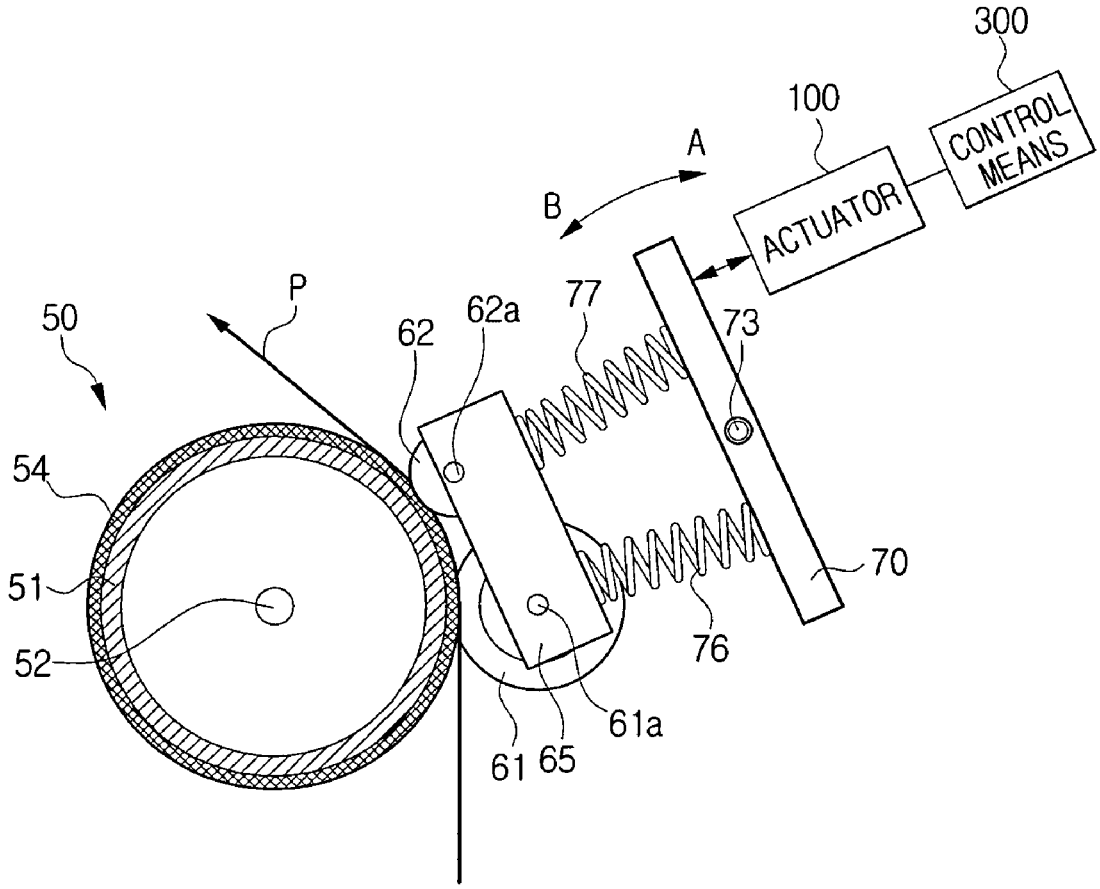
FIG. 4 is an elevational view of an image fixing apparatus according to a third exemplary embodiment of the present invention, wherein various actuators and related arrangements thereof that may be employed in the image fixing apparatus are shown in FIGS. 4A to 4E.

FIG. 4 conceptually shows the construction of an image fixing apparatus according to a third exemplary embodiment of the present invention.

As shown in the FIG. 4, the image fixing apparatus according to the third exemplary embodiment includes a heat roller 50 for transferring heat to a record medium P to fix a toner image to the record medium P, and pressure rollers 61 and 62 for compressing the record medium P against the heat roller 50.

The heat roller 50 has a substantially cylindrical rotary body 51 formed of a metallic material, such as aluminum, which is superior in heat conductivity, wherein the rotary body 51 is installed in such a manner as to be rotatable by a driving source, such as a driving motor.

A heat source 52, such as halogen lamp is provided within the rotary body 51, and a sheath 54 is provided around the peripheral surface of the rotary body 51, wherein the sheath 54 is formed of a resilient member, such as silicon polymer or elastomer, and is coated, with Teflon for example, on the peripheral surface of the sheath 54 to render a toner image to be easily released.

The first and second pressure rollers 61 and 62 rotationally contact the sheath 54 of the heat roller 50, and the respective rotary shafts 61*a* and 62*a* of the first and second pressure rollers 61 and 62 are rotatably supported by a pair of left and right bushing members 65 at the opposite ends thereof.

A first image fixing nip N1 is formed at the area where the heat roller 50 and the first pressure roller 61 rotationally contact each other and a second image fixing nip N2 is formed at the area where the heat roller 50 and the second pressure roller 62 rotationally contact each other.

The pair of the bushing members 65 have support holes 66 and 67 for rotationally supporting the opposite ends of the respective rotary shafts 61*a* and 62*a* of the first and second pressure rollers 61 and 62, and each of the support holes 66 and 67 may be provided with a bearing to support the respective shafts 61*a* and 62*a* in such a manner as to be smoothly rotated. The pair of the bushing members 65 may be integrally formed.

A pair of support members 70 are arranged at a distance from the respective bushing members 65 and plural compression portions 76 and 77 are resiliently disposed between the bushing members 65 and the support members 70, respectively. Here, the pair of the support members 70 may be integrally formed.

The third exemplary embodiment includes plural compression portions 76 and 77 for independently applying compressive forces to the plural pressure rollers 61 and 62. That is, the compressing directions of the respective compression portions 76 and 77 are directed to the centers of the respective pressure rollers 61 and 62, so that the compressive forces applied by the respective pressure rollers 61 and 62 may be equal to or different from each other.

Figure 4A:
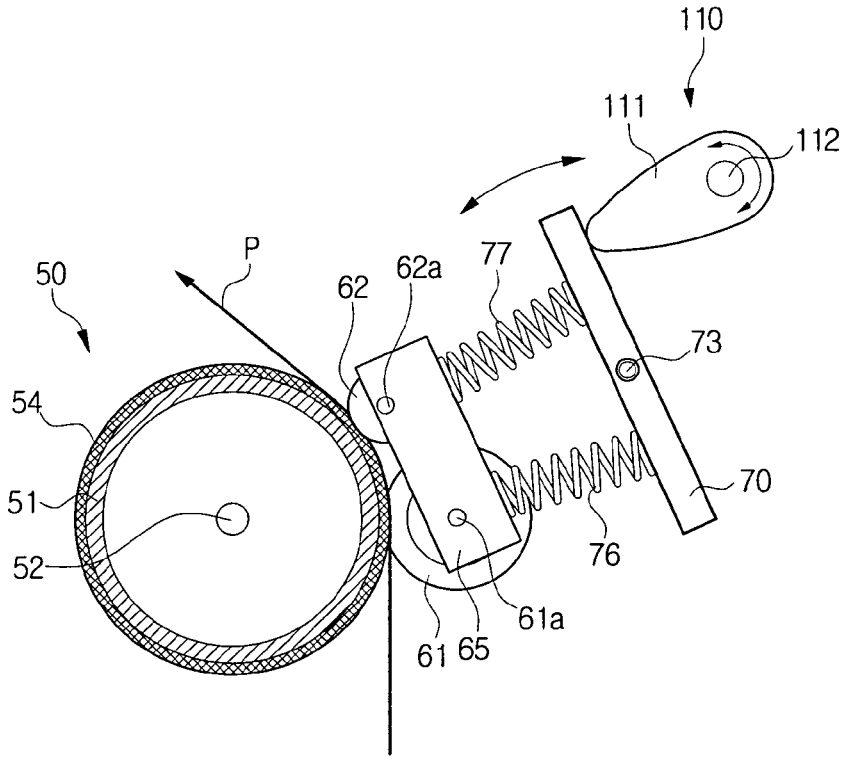
Figure 4B:
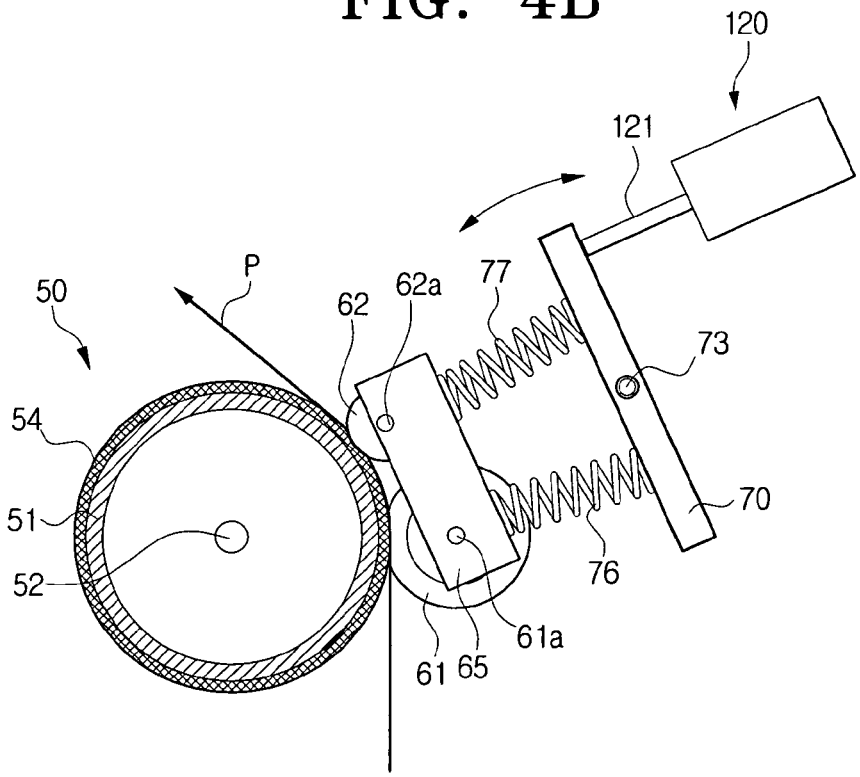
Figure 4C:
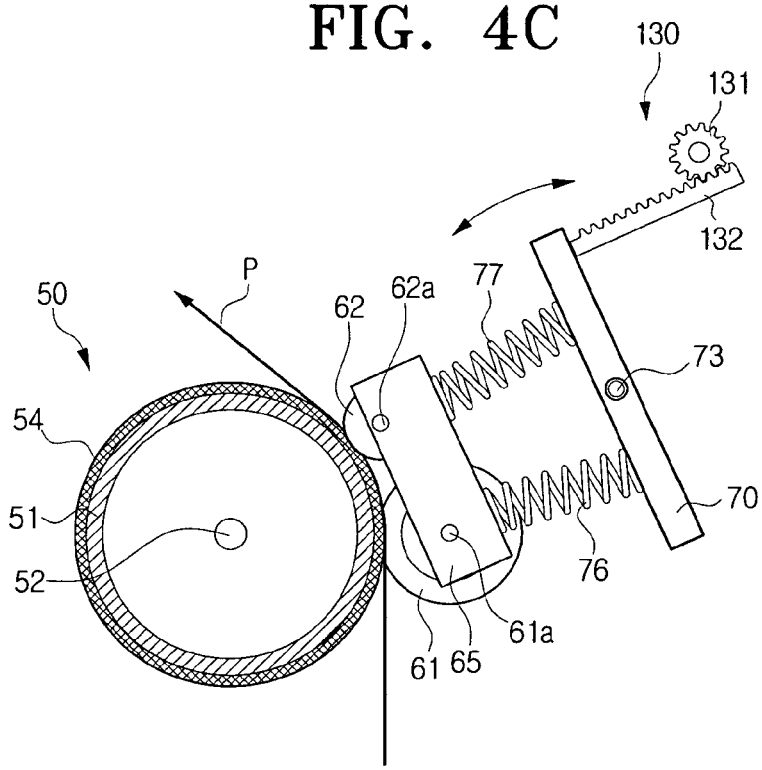
Figure 4D:
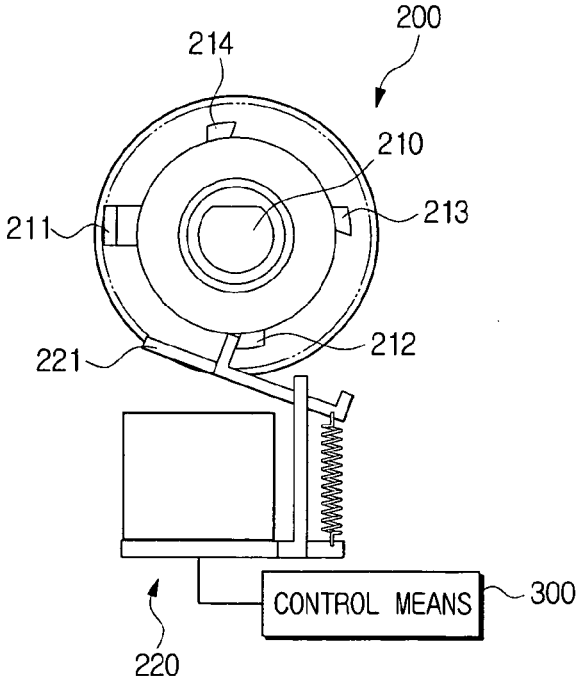
Figure 4E:
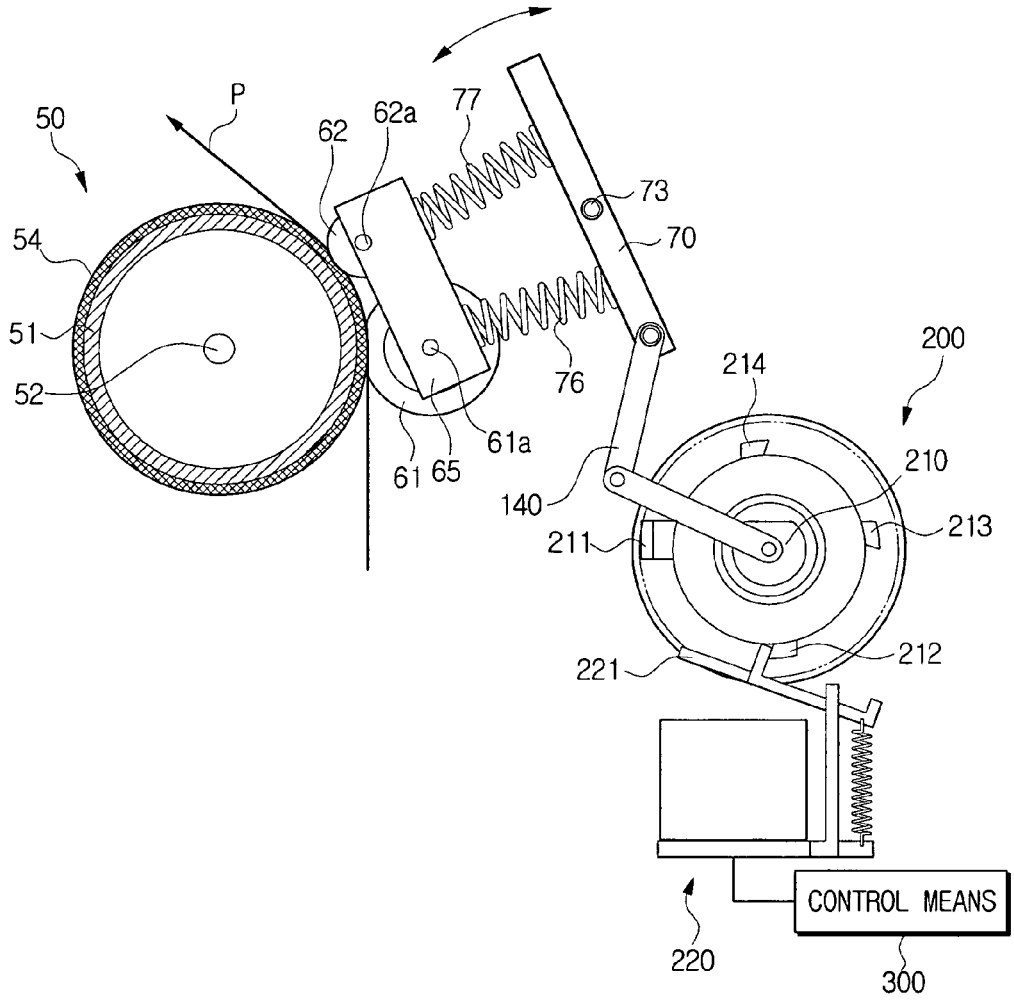

For example, when the plural pressure rollers are composed of two pressure rollers, that is, first and second pressure rollers 61 and 62 as shown in FIGS. 4 to 4E, the corresponding plural compression portions are also composed of two compression portions, that is, first and second compression portions 76 and 77.

As exemplified in FIGS. 4 to 4E, the first compression portion 76 independently applies compressive force to the rotary shaft 61*a* of the first pressure roller 61, and the second compression portion 77 independently applies compressive force to the rotary shaft 62*a* of the second pressure roller 62.

When the number of the pressure rollers is three or more, the number of the compression portions is also three or more, so that each compression portions independently applies compressive forces to a corresponding pressure roller.

Although each of the first and second compression portions 76 and 77 is shown as being composed of a single spring in FIGS. 4 to 4E, the third exemplary embodiment of the present invention is not limited to such a configuration and each compression portion may be composed of two or more springs.

Accordingly, the number of springs constituting the first compression portion 76 may be different from the number of springs constituting the second compression portion 77.

Additionally, the respective springs of the first and second compression portions 76 and 77 may be equal to or different from each other in elastic coefficient and length.

The third embodiment is technically characterized by the fact that the relative ratio of the compressive forces applied to the plural pressure rollers 61 and 62 may be adjusted because the support member 70 is provided in such a manner as to be pivotable about a pivot point 73 in relation to a frame (not shown) of an image fixing apparatus.

By the pivotal movement of the support member 70, the plural compression portions 76 and 77 disposed between the support member 70 and the bushing member 65 may variably apply compressive forces, so that the relative ratio of the compressive forces applied to the first and second pressure rollers 61 and 62 may be adjusted. In FIG. 4, when the support member 70 is pivoted in the direction indicated by arrow A from its reference position (for example, neutral position where the compressive forces applied by the first and second compression portions 76 and 77 are substantially equal to each other), the compressive force applied by the support member 70 is increased, whereby the compressive force applied to the first pressure roller 61 is also increased. The second compression portion 77 is elongated and thus the compressive force applied by the second compression portion 77 is relatively reduced, whereby the compression force applied to the second pressure roller 62 is also reduced.

When the support member 70 is pivoted in the direction indicated by arrow B, the compressive force of the second compression portion 77 is increased, whereby the compressive force applied to the second pressure roller 62 is also increased. The compressive force of the first compression portion 76 is relatively reduced, whereby the compressive force applied to the first pressure roller 61 is reduced.

For example, when the support member 70 is pivoted in the direction indicated by arrow A in FIG. 4, if a thin paper, an envelope or the like passes the image fixing nips N1 and N2 of the image fixing apparatus, the compressive force applied to the second compression roller 62 is smaller than that applied to the first pressure roller 61, whereby the thin paper, the envelope or the like is efficiently prevented from being crumpled or wrinkled between the heat roller 50 and the second pressure roller 62.

Additionally, when the support member 70 is pivoted in the direction indicated by arrow B in FIG. 4, an ordinary paper or a thick paper passes the image fixing nips N1 and N2 of the fixing apparatus, the compressive force applied to the second pressure roller 62 is larger than that applied to the first pressure roller 61, whereby the wrap jam phenomenon may be prevented as the ordinary paper or the thick paper may be flattened and discharged by the increased compressive force of the second pressure roller 62.

That is, the thick paper, which has passed the first image fixing nip N1, is flattened in the direction opposite to the heat roller 50 by the increased compressive force of the second pressure roller 62 in the process of passing the second image fixing nip N2. Thus, a toner image may be more smoothly released and the wrap jam phenomenon may be prevented.

Additionally, because the relative ratio of the compressive forces respectively applied to the plural pressure rollers 61 and 62 is adjustable, the total sum of the compressive forces is substantially constant.

The third exemplary embodiment includes an actuator 100 for pivoting the support member 70 about the pivot point 73, wherein the actuator 100 may be configured in a manually controllable construction like a lever mechanism, a cam mechanism, a gear transmission mechanism and the like or an electronically controllable construction controlled using control means. The operation of the electronically controllable actuator 100 is controlled by the control means 300.

Preferably, the control means 300 is connected to a control board of an image forming apparatus or a PC, so that a user may properly select the parameters of a record medium (thickness, size, quality of material and the like) and/or the density of a toner image on the control board of the image forming apparatus or on the PC, whereby the control means controls the actuator 100 on the basis of the selected information.

Alternatively, the control means 300 may be connected to a detection sensor (not shown) for detecting the parameters of a record paper (thickness, size, quality of material and the like), so that the control means 300 controls the actuator 100 on the basis of the detection signals of the detection sensor.

Additionally, the control means 300 may be connected to a detection sensor (not shown) for detecting the density of a toner image, so that the control means 300 controls the actuator 100 on the basis of the detection signals of the detection sensor.

The specific forms of such electronically controllable actuators 100 are shown in FIGS. 4A to 4E.

FIG. 4A shows a first specific form of an actuator 100, which employs a cam mechanism 110, wherein the cam mechanism 110 is pivoted about a pivot point 73 by compressing an area of the support member 70, which is eccentrically arranged in relation to the pivot point 73, whereby the relative ratio of the compressive forces applied to the respective pressure rollers 61 and 62 may be adjusted.

Such a cam mechanism 110 includes a cam member 111, which is eccentrically positioned and rotated in relation to the pivot point 73 to pivot the support member 70 about the pivot point 73, and a rotary shaft 112 for rotating the cam member 111, wherein the rotary shaft 112 may be provided in such a manner as to cooperate with various driving motors (not shown) of the image fixing apparatus or the image forming apparatus.

The outer surface of the support member 70, which comes into contact with the cam member 111, may be provided with various forms of control surfaces (not shown) to render the support member 70 to be smoothly and rectilinearly reciprocated.

Alternatively, the rotary shaft 112 may be installed in such a manner as to cooperate with the driving unit 200, which is exemplified in FIG. 4D. The driving unit 200 includes a driving shaft 210, which is separably connected with an end of the rotary shaft 112 via a clutch (not shown) or the like, plural phase control projections 211, 212, 213 and 214 arranged around the peripheral surface of the driving shaft 210, and a solenoid 220, which is located outside of the driving shaft 210 to control the phase control projections 211, 212, 213 and 214.

The driving shaft 210 may be cooperatively connected with various driving motors (not shown) for the heat roller of the image fixing apparatus, or a transfer roller or a developing rollers of the image forming apparatus through a gear train or the like, wherein the rotational force of the driving shaft 210 is intermittently transmitted to the rotary shaft 112 through the clutch (not shown) or the like.

From the peripheral surface of the driving shaft 210, the plural phase control projections 211, 212, 213 and 214 are protruded. As the movable body 221 of the solenoid 220 is selectively engaged with the respective phase control projections 211, 212, 213 and 214, the rotary shaft 112 of the cam mechanism 100 may be adjusted in rotating angle, as a result of which, the rotation angle of the cam member 111 is adjusted in unison, whereby the support member 70 is pivoted about the pivot point 73.

The solenoid 220 is electrically connected to the control means 300, so that the movement of the movable body 221 of the solenoid 220 is controlled by the control means 300. Although the solenoid 220 employed in the driving unit 200 is shown as an armature type solenoid, the movable body of which is swiveled by an electromagnet and a spring in FIG. 4D, the present exemplary embodiment is not limited to such a configuration and various solenoids, such as plunger types, latch types and the like are applicable to the present exemplary embodiment.

FIG. 4B shows a second specific forms of the actuator 100 that employs a solenoid 120. When the movable body 121 of the solenoid 120 compresses one side of the support member 70 (that is, an area eccentrically positioned in relation to the pivot point 73), the support member 70 are pivoted about the pivot point 73, whereby the relative ratio of the compressive forces applied to the respective pressure rollers 61 and 62 may be adjusted.

As the solenoid 120 is electrically connected to the control means 300 and the movable body 121 of the solenoid 120 is activated by the control means 300, the support member 70 is pivoted about the pivot point 73.

Although the solenoid 120 is shown as a plunger type, the movable body 120 of which is rectilinearly moved by an electromagnet, the solenoid of the present exemplary embodiment is not limited to such a configuration, and various types of solenoids, such as armature types, latch types and the like are applicable to the present exemplary embodiment.

FIG. 4C shows a third specific form of an actuator 100, which employs a gear transmission mechanism 130, wherein the gear transmission mechanism 130 includes a rotationally driven pinion 131 and a rack 132, which is meshed with the pinion 131.

The pinion 131 may be cooperatively connected with a driving source (not shown), such as driving motors for driving the heat roller of the image fixing apparatus, or a transfer roller or a developing roller of an image forming apparatus, through a gear train or the like.

The rack 132 converts the rotational movement of the pinion gear 131 to rectilinear movement so as to compress one end of the support member 70 (that is, an area eccentrically positioned in relation to the pivot point 73), so that the support member 70 is pivoted about the pivot point 73, whereby the relative ratio of the compressive forces applied to the respective pressure rollers 61 and 62 may be adjusted.

As the control means 300 is connected to the driving source (not shown), to which the above-mentioned pinion 131 is connected, the rotational movement of the pinion 131 may be controlled by the control means 300.

Alternatively, the pinion 131 may be intermittently connected to the driving shaft 210 of the driving unit 200 shown in FIG. 4D through a clutch, so that the pinion 131 may be controlled by the driving unit 200.

FIG. 4E shows a fourth specific form of an actuator 100 that employs the driving unit 200 shown in FIG. 4D and a link mechanism 140.

In the fourth exemplary embodiment, one end of the link mechanism 140 is connected to the driving shaft 210 of the driving unit 200, and the other end of the link mechanism 140 is connected to one end of the support member 70 (that is, an area eccentrically positioned with respect to the pivot point). The rotational movement of the driving shaft 210 is converted into rectilinear movement through the link mechanism 140, and when the rectilinear movement of the link mechanism 140 is transmitted to the support member 70, the support member 70 is pivoted about the pivot point 73. Consequently, the relative ratio of the compressive forces applied to the respective pressure rollers 61 and 62 may be adjusted.

The actuator 100 applied to the third exemplary embodiment is not limited to the first to the fourth specific forms of actuators, and various types of actuators are applicable to the fourth exemplary embodiment to pivot the support member 70 about the pivot point 73.

Figure 5:
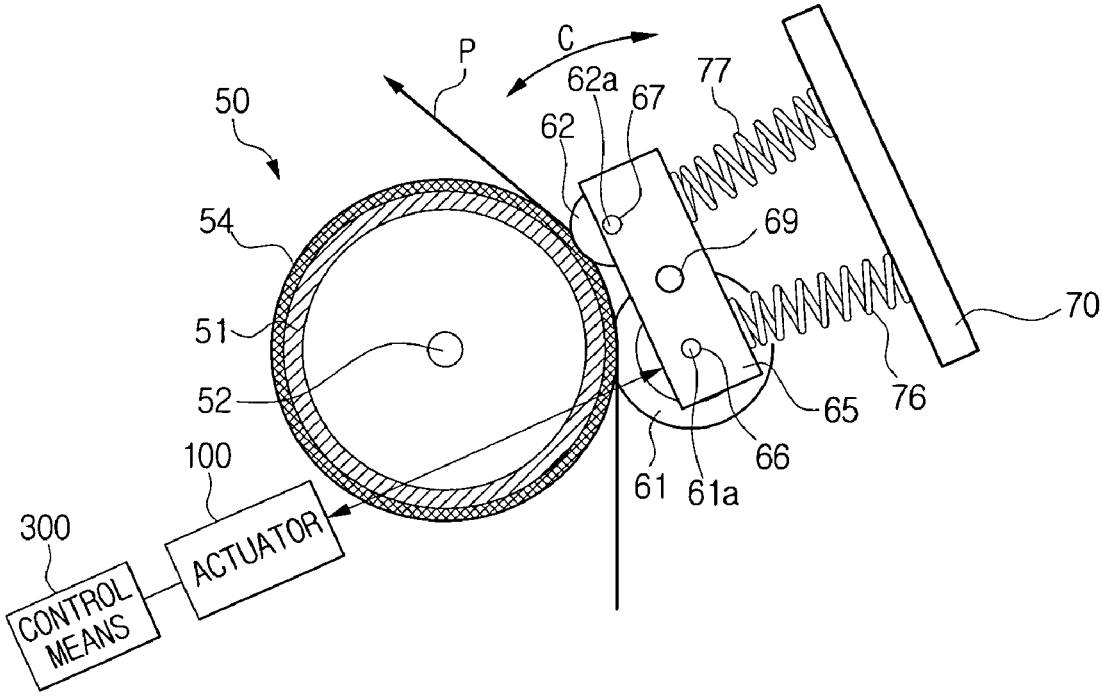
FIG. 5 is an elevational view of an image fixing apparatus according to a fourth exemplary embodiment of the present invention, wherein various actuators and related arrangements thereof that may employed in the image fixing apparatus are shown in FIGS. 5A to 5E.
Figure 5A:
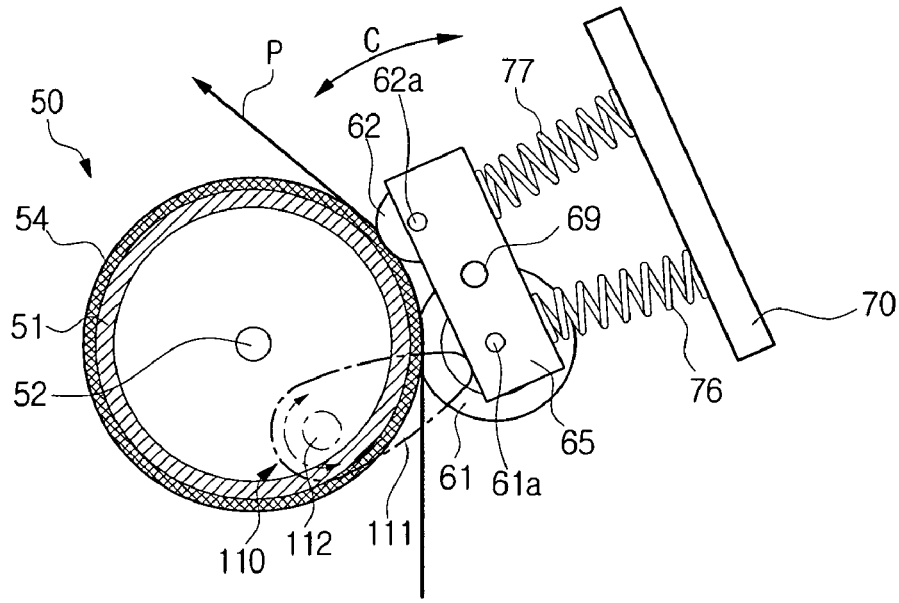
Figure 5B:
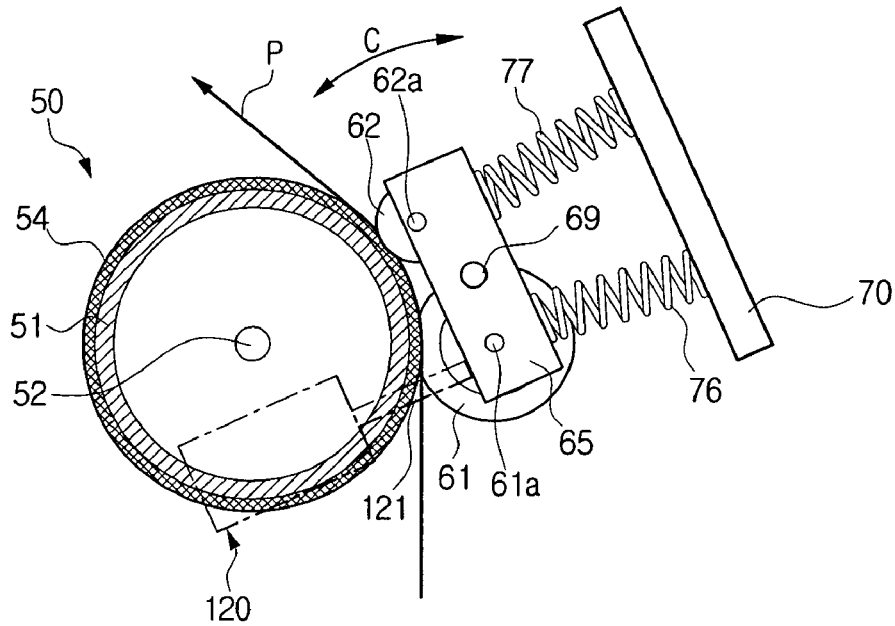
Figure 5C:
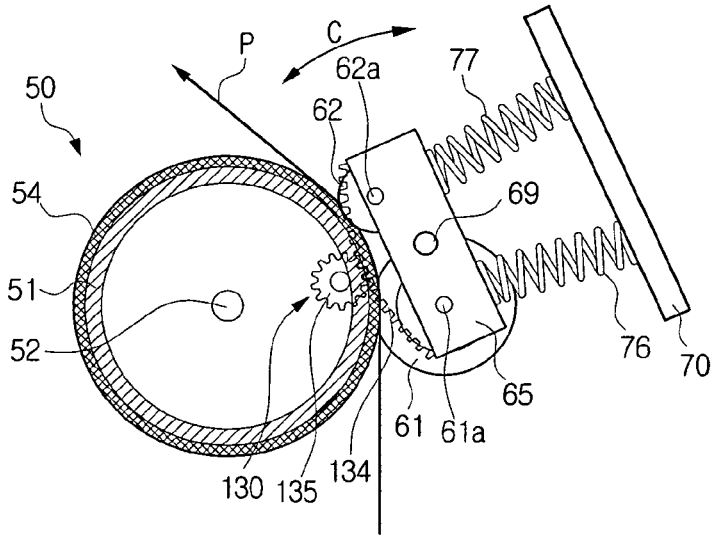
Figure 5D:
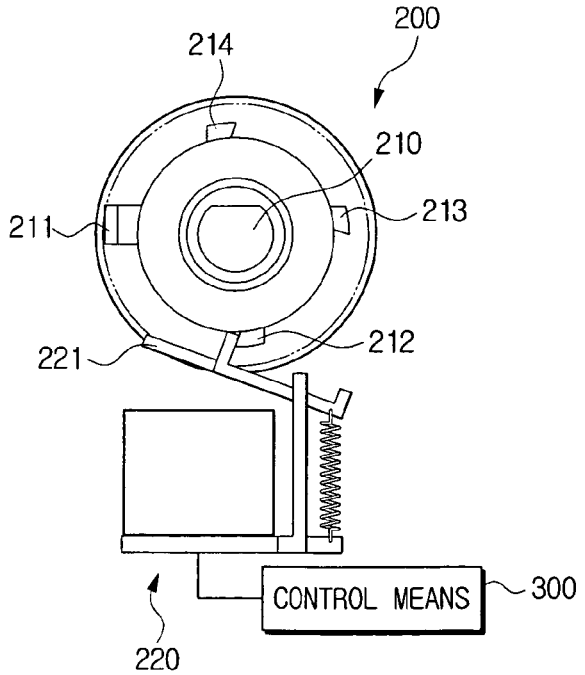
Figure 5E:
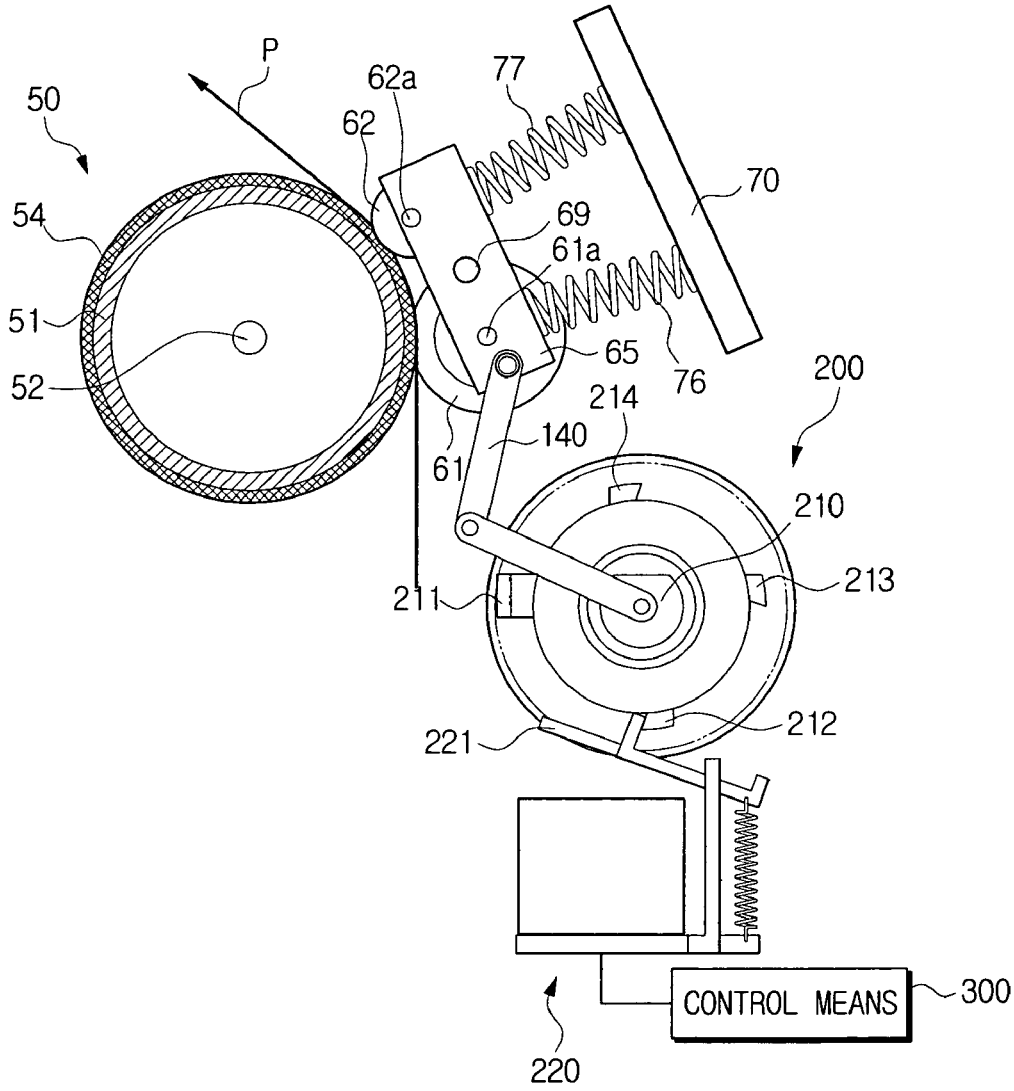

FIGS. 5 to 5E conceptually show a fourth exemplary embodiment of the present invention.

As shown in FIG. 5, the fourth exemplary embodiment of the present invention includes a heat roller 50, plural pressure rollers 61 and 62, and compression portions 76 and 77 for compressing the pressure rollers 61 and 62.

The compression portions 76 and 77 are resiliently disposed between bushing member 65 and support member 70, the bushing member 65 being provided in such a manner as to be pivotable about a pivot point 69, which is provided on the bushing member 65. The support member 70 is fixedly provided on a frame (not shown) of an image fixing apparatus.

The third exemplary embodiment is configured in such a way that, as the support member 70 is pivoted about the pivot point 73 by an actuator or the like, the relative ratio of the compressive forces, which are independently applied to the plural pressure rollers 61 and 62, may be adjusted. Alternatively, the fourth exemplary embodiment is technically characterized by the fact that the relative ratio of the compressive forces, which are independently applied to the plural pressure rollers 61 and 62, may be adjusted as the bushing member 65 is pivoted (in the direction indicated by arrow C) about the pivot point 69 of the bushing members 65 by an actuator or the like.

Alternatively, the fourth exemplary embodiment may be arranged in such a way that the bushing member 65 is installed to be pivotable about a pivot point provided on the bushing member 69 and the support member 70 is movable in relation to the frame (not shown) of the image fixing apparatus.

In the alternative construction of the fourth exemplary embodiment, when the support member 70 is pivoted about the pivot point 69 of the bushing member 65, the applying directions as well as the magnitudes of the compressive forces of the respective compression portions 76 and 77 are adjusted, so that the relative ratio of the compressive forces applied to the respective pressure rollers 61 and 62 may be finely adjusted.

The fourth exemplary embodiment of the present invention includes an actuator 100 that pivots the support member 70 or the bushing member 65 about the pivot point, wherein the actuator 100 may be configured to be manually controllable like a lever mechanism, a cam mechanism, a gear transmission mechanism, or the like, or electronically controllable using control means. The operation of the electronically controllable actuator 100 is controlled by the control means 300.

Preferably, the control means 300 is connected to a control board of an image forming apparatus or a PC, so that a user may properly select the parameters of a record medium (thickness, size, quality of material and the like) and/or the density of a toner image on the control board of the image forming apparatus or the PC, whereby the control means 300 controls the actuator 100 on the basis of the selected information.

Alternatively, the control means 300 may be connected to a detection sensor (not shown) for detecting the parameters of a record medium (thickness, size, quality of material and the like), so that the control means 300 controls the actuator 100 on the basis of the detection signals of the detection sensor.

Additionally, the control means 300 may be connected to a detection sensor (not shown) for detecting the density of a toner image, so that the control means controls the actuator 100 on the basis of the detection signals of the detection sensor.

Various specific forms of electronically controllable actuators 100 are shown in FIGS. 5A to 5E.

FIG. 5A shows a first exemplary embodiment of an actuator 100, which employs a cam mechanism 110, wherein the cam mechanism 110 compresses one end of the bushing member 65, thereby pivoting the bushing member 65 about the pivot point 69 (as indicated by arrow C), whereby the relative ratio of the compressive forces applied to respective pressure rollers 61 and 62 may be adjusted.

Such a cam mechanism 110 includes a cam member 111, which is eccentrically rotated on one side of the bushing member 65 to pivot the bushing member 65 about the pivot point 69, and a rotary shaft 112 for rotating the cam member 111. The rotary shaft 112 may be provided in such a manner as to cooperate with various driving motors (not shown) of the image fixing apparatus or the image forming apparatus.

The outer surface of the bushing member 65, which comes into contact with the cam member 111, may be provided with various forms of control surfaces (not shown) to render the bushing member 65 to be smoothly and rectilinearly reciprocated.

Alternatively, the rotary shaft 112 may be installed in such a manner as to cooperate with the driving unit 200 exemplified in FIG. 5D. The driving unit 200 includes a driving shaft 210, which is separably connected with an end of the rotary shaft 112 via a clutch (not shown) or the like, plural phase control projections 211, 212, 213 and 214 arranged around the peripheral surface of the driving shaft 210, and a solenoid 220, which is located in the outside of the driving shaft 210 to control the phase control projections 211, 212, 213 and 214.

The driving shaft 210 may be cooperatively connected with various driving motors (not shown) for the heat roller of the image fixing apparatus, or a transfer roller or a developing roller of the image forming apparatus through a gear train or the like, wherein the rotational force of the driving shaft 210 is intermittently transmitted to the rotary shaft 112 through the clutch (not shown) or the like.

From the peripheral surface of the driving shaft 210, the plural phase control projections 211, 212, 213 and 214 are protruded, wherein as the movable body 221 of the solenoid 220 is selectively engaged with the respective phase control projections 211, 212, 213 and 214, the rotary shaft 112 of the cam mechanism 100 may be adjusted in rotating angle, and as the rotation angle of the cam member 111 is adjusted in unison, the bushing members 65 are pivoted about the pivot point 69. Meanwhile, the solenoid 220 is electrically connected to the control means 300, so that the movement of the movable body 221 of the solenoid 220 is controlled by the control means 300.

Although the solenoid 220 employed in the driving unit 200 is shown as an armature type solenoid, the movable body of which is swiveled by an electromagnet and a spring, in FIG. 5D, the present exemplary embodiment is not limited to such a configuration and various solenoids, such as plunger types, latch types and the like, are applicable to the present exemplary embodiment.

FIG. 5B shows a second specific of an actuator 100, which employs a solenoid 120, wherein if the movable body 121 of the solenoid 120 compresses one side of the bushing member 65, the bushing member 65 is pivoted about the pivot point 69, whereby the relative ratio of the compressive forces applied to the respective pressure rollers 61 and 62 may be adjusted.

As the solenoid 120 is electrically connected to the control means 300 and the movable body 121 of the solenoid 120 is activated by the control means 300, the bushing member 65 is pivoted about the pivot point 69.

Although the solenoid 120 is shown as a plunger type, the movable body 120 of which is rectilinearly moved by an electromagnet, in FIG. 5B, the solenoid of the present exemplary embodiment is not limited to such a configuration, and various types of solenoids, such as armature types, latch types and the like, are applicable to the present exemplary embodiment.

FIG. 5C shows a third specific form of an actuator 100, which employs a gear transmission mechanism 130, wherein the gear transmission mechanism 130 includes a driven gear 134, which is integrally formed on the peripheral surface of the bushing member 65 in a form of circular arc, and a driving gear 135 for driving the driven gear 134.

The driven gear 134 may be integrally formed on or assembled with the outer surface of the bushing member 65 in such a manner as to correspond to a pivot track of the bushing member 65.

The driving gear 135 is meshed with the driven gear 134, and cooperatively connected with a driving source (not shown), such as driving motors for driving the heat roller of the image fixing apparatus, or a transfer roller or a developing roller of the image forming apparatus, through a gear train.

When the rotational force of the driving gear 135 is transmitted to the driven gear 134, the driven gear 134 and the bushing member 65 are pivoted in unison about the pivot point 69 of the bushing member 65 (as indicated by arrow C), whereby the relative ratio of the compressive forces applied to the respective pressure rollers 61 and 62 may be adjusted.

As the control means 300 is connected to the driving source (not shown), to which the above-mentioned driving gear 135 is connected, the rotational movement of the driving gear 135 may be controlled by the control means 300.

Alternatively, the rotary shaft of the driving gear 135 may be separably connected to the driving shaft 210 of the driving unit shown in FIG. 5D through a clutch or the like, so that the driving gear 135 may be controlled by the driving unit 200.

The gear transmission mechanism 130 of the actuator of the third specific form may be of a rack and pinion type as shown in FIG. 5C to compress one side of the bushing member 65, thereby pivoting the bushing member 65 about the pivot point 69.

FIG. 5E shows a fourth specific form of an actuator 100 that employs the driving unit 200 shown in FIG. 5D and a link mechanism 140.

In the fourth specific form, one end of the link mechanism 140 is connected to the driving shaft 210 of the driving unit 200, and the other end of the link mechanism 140 is connected to one end of the bushing member 65, whereby the rotational movement of the driving shaft 210 is converted into rectilinear movement through the link mechanism 140. When the rectilinear movement of the link mechanism 140 is transmitted to the bushing member 65, the bushing member 65 is pivoted about the pivot point 69. Consequently, the relative ratio of the compressive forces applied to the respective pressure rollers 61 and 62 may be adjusted.

Although the configurations of the actuators 100 shown in FIGS. 5A to 5E have been shown and described as the bushing member 65 is pivoted about the pivot point 69, the fourth exemplary embodiments are not limited to such configurations, and it is also possible to provide alternative constructions that pivot the bushing member 65 about the pivot point 69.

Additionally, an actuator 100 applicable to the fourth exemplary embodiment is not limited to the first to the fourth specific forms, and other various types of actuators are applicable to pivot the support member 65 about the pivot point 69.

Figure 6:
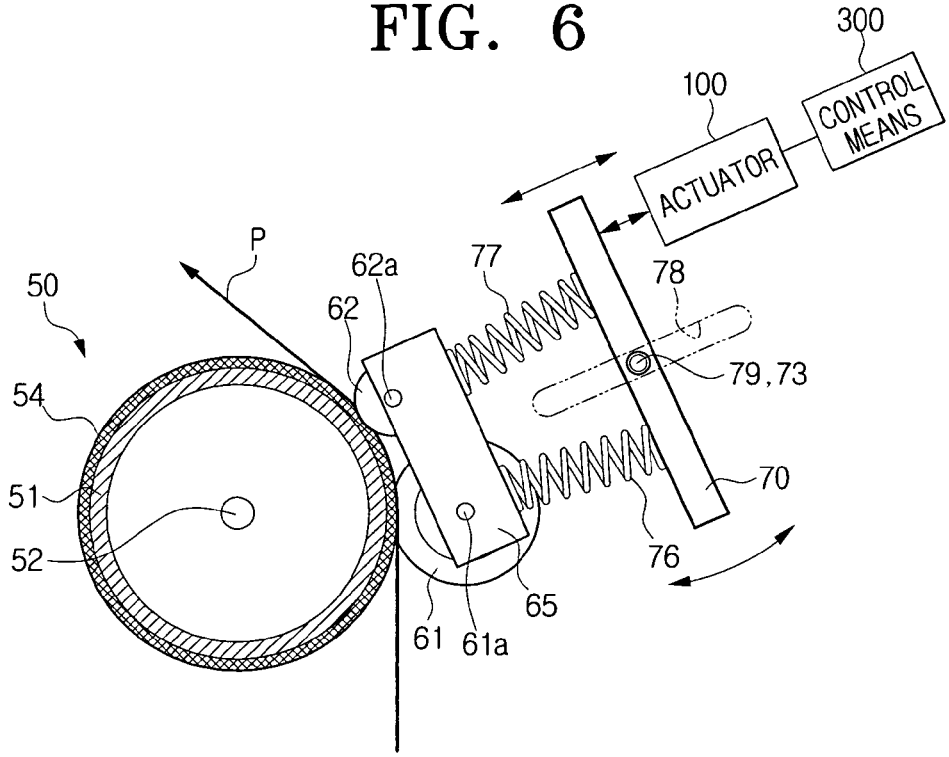
FIG. 6 is an elevational view of an image fixing apparatus according to a fifth exemplary embodiment of the present invention, wherein various actuators and related arrangements thereof that may employed in the image fixing apparatus are shown in FIGS. 6A and 6B.
Figure 6A:
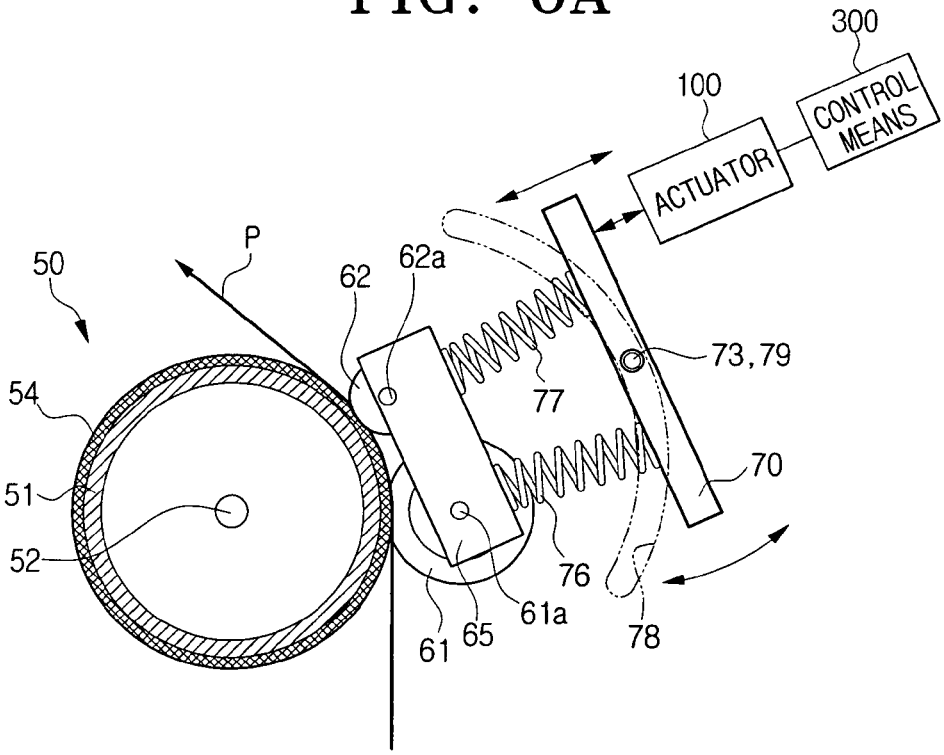
Figure 6B:
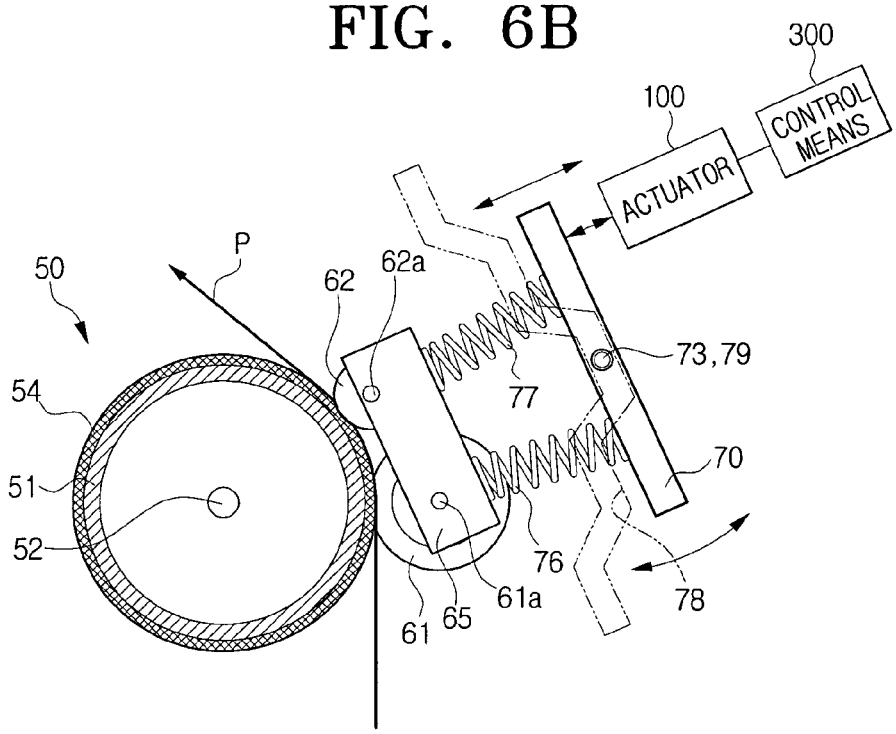

FIGS. 6 to 6B conceptually show a fifth exemplary embodiment of the present invention.

As shown in FIG. 6, the fifth exemplary embodiment of the present invention includes a heat roller 50, plural pressure rollers 61 and 62, and compression portions 76 and 77.

The plural compression portions 76 and 77 are resiliently disposed between bushing member 65 and support member 70, wherein the support member 70 is provided in such a manner as to be movable in relation to a frame (not shown) of an image fixing apparatus as well as to be pivotable about the pivot point 73.

With the construction concerning the movement of the support member 70, the movement of the support member 70 is guided through one or more guide grooves and one or more guide projections 78 and 79, which are provided at the neighboring portions of a frame (not shown) of an image fixing apparatus and the support member 70 to correspond to each other, as shown in FIGS. 6 to 6B.

The actuator 100 for moving and/or pivoting the support member 70 may be applied to the first to fourth exemplary embodiments, or other various forms of actuators 110, 120, 130, 140 and 200 may be selectively employed.

The fifth exemplary embodiment is technically characterized by the fact that the distance between the heat roller 50 and the support member 70 is adjusted due to the movable construction of the support member 70, thereby the total sum of the compressive forces applied to the plural pressure rollers may be adjusted. As the support member 70 is pivoted about the pivot point 73, the relative ratio of the compressive forces, which are independently applied to the pressure rollers 61*a* n 62, may be adjusted.

In the fifth exemplary embodiment, a guide projection 79 and a pivot point 73 may be formed at an identical position or different positions in the support members 70 as shown in FIGS. 6 to 6B. The support member 70 may be pivoted about the pivot point 73 in the state of being fixed at a predetermined position by a stopper (not shown) or the like after moved to the predetermined position along the guide groove 78.

Figure 7:
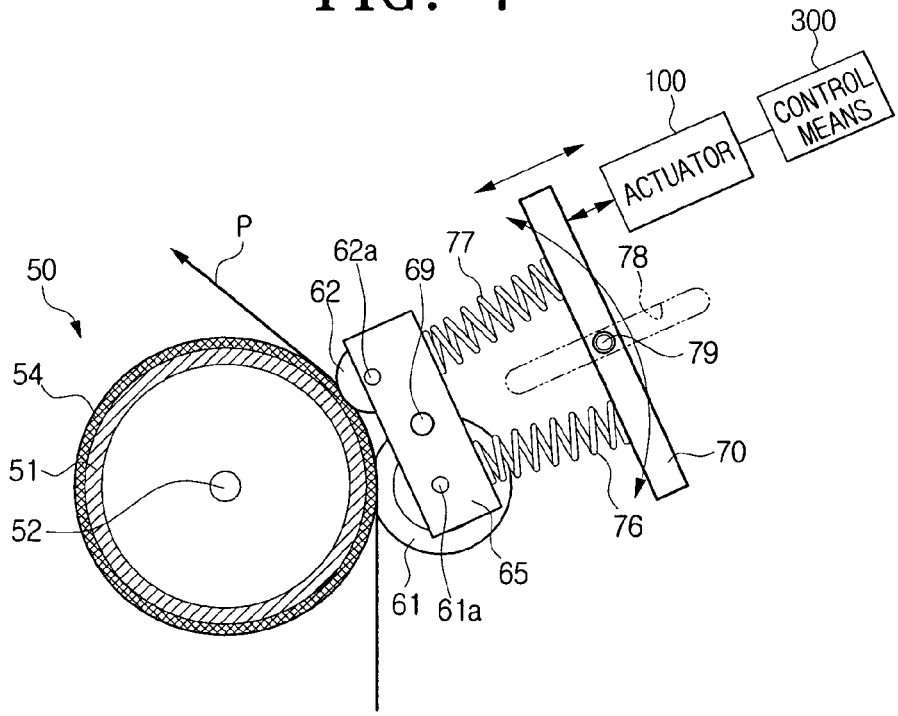
FIG. 7 is an elevational view of an image fixing apparatus according to a sixth exemplary embodiment of the present invention, wherein various actuators and related arrangements thereof that may be employed in the image fixing apparatus are shown in FIGS. 7A and 7B.
Figure 7A:
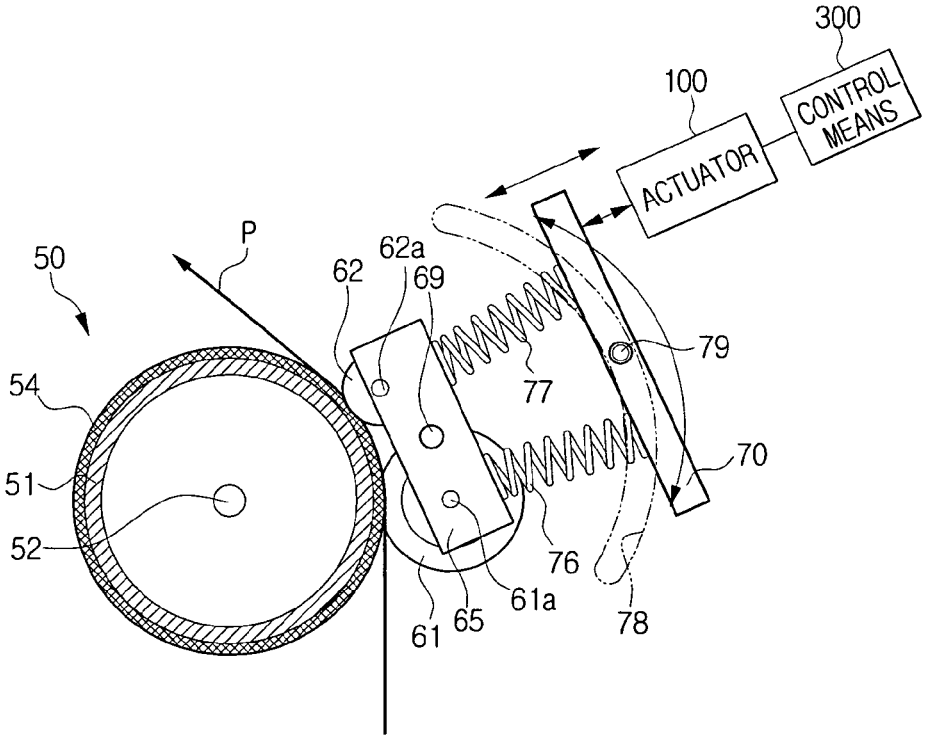
Figure 7B:
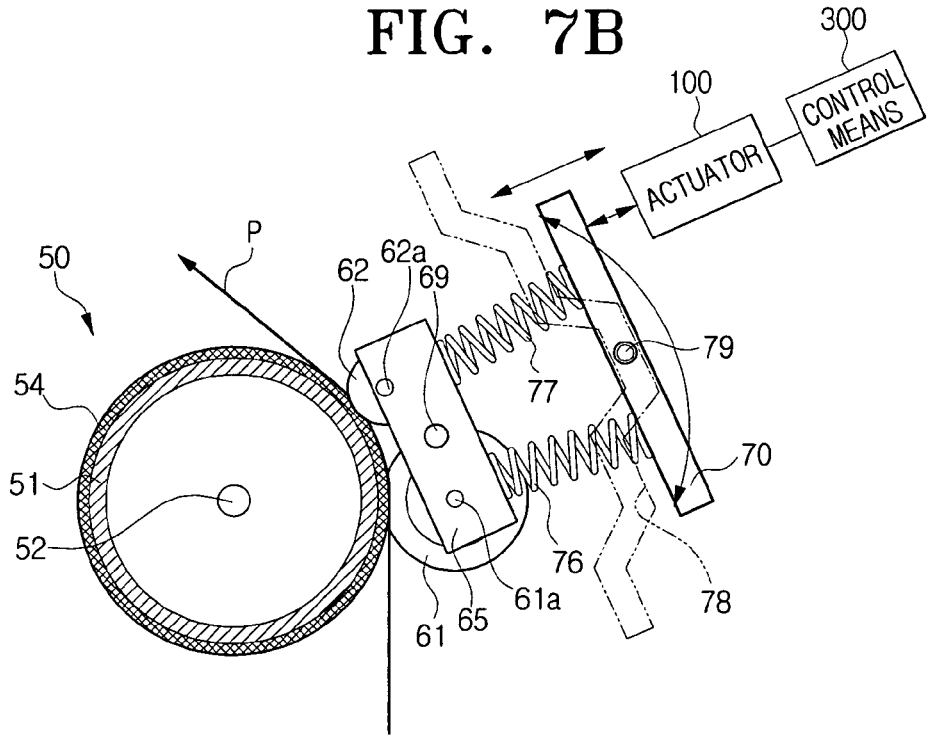

FIGS. 7 to 7B conceptually show a sixth exemplary embodiment of the present invention.

The sixth exemplary embodiment of the present invention arranges a pivot point 69, which serves as a center of pivot when support members 70 or the bushing member 65 is pivoted, whereby the relative ratio and directions of the compressive forces applied to the respective pressure rollers 61 and 62 may be adjusted.

Additionally, in the sixth exemplary embodiment, the support member 70 is guided through the guide structures 78 and 79 described in the first, second and fourth exemplary embodiments to adjust the distance between the heat roller 50 and the support member 70, whereby the total sum of the compressive forces applied to the plural pressure rollers 61 and 62 may be adjusted.

In the sixth exemplary embodiment, the support member 70, which has been moved to a predetermined position along the guide groove 78 by the actuator 100, is stopped at the position by a stopper (not shown) or the like, and in this state, the actuator 100 may pivot the support member 70 or the bushing member 65 about the pivot point 69.

Additionally, the pivot projection 79 of the support members 70 may be used as the pivot point 79 when the support member 70 is pivoted.

That is, the actuator 110 of the sixth exemplary embodiment moves the support member 70 through the guide structure 78 and 79, and pivots the support member 70 and the bushing member 65 about the pivot points 79 and 69, respectively.

Because the other constructions and acting relationships are substantially similar to the first to fifth exemplary embodiments, a detailed description thereof is omitted.

As described above, the fifth and sixth exemplary embodiments adjust the total sum of the compressive forces and the relative ratio of the respective compressive forces according to the thickness, characteristic of a record medium and the density of a toner image deposited to the record medium, whereby more efficient image fixing characteristics may be realized.

Figure 8:
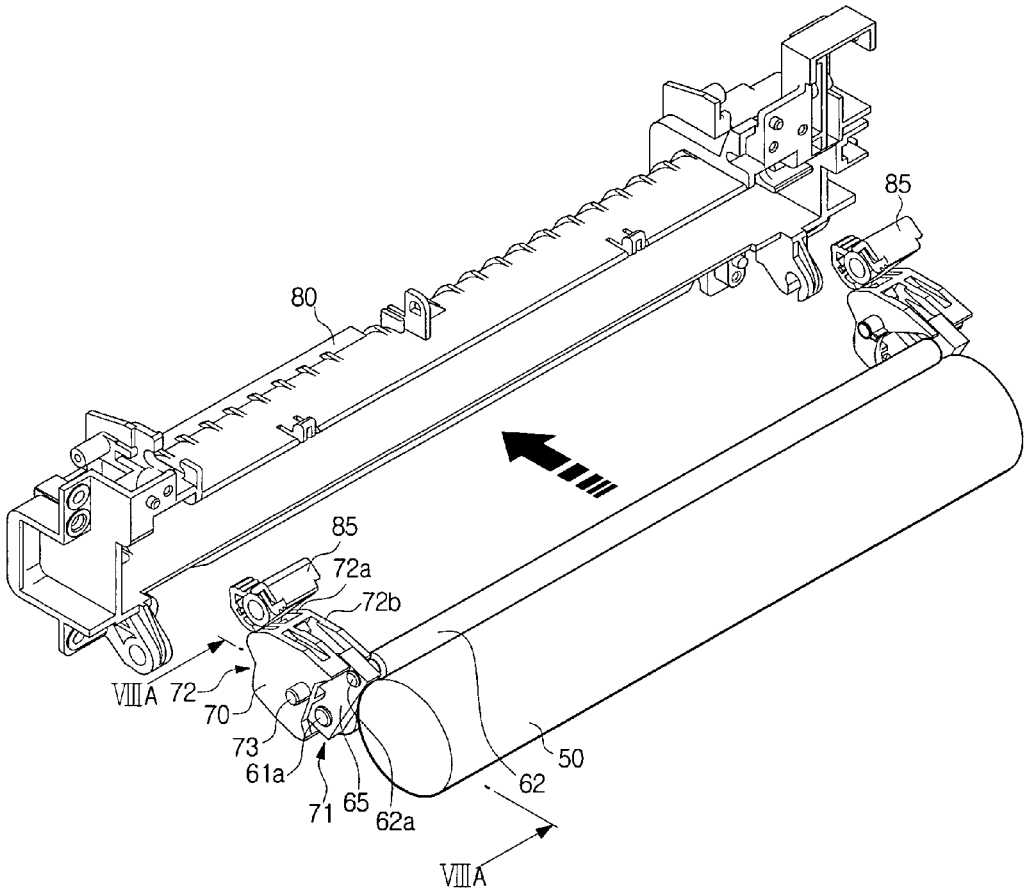
FIGS. 8, 8A, 9 and 9A are elevational and perspective views of the image fixing apparatus according to the third exemplary embodiment of the present invention.
Figure 9:
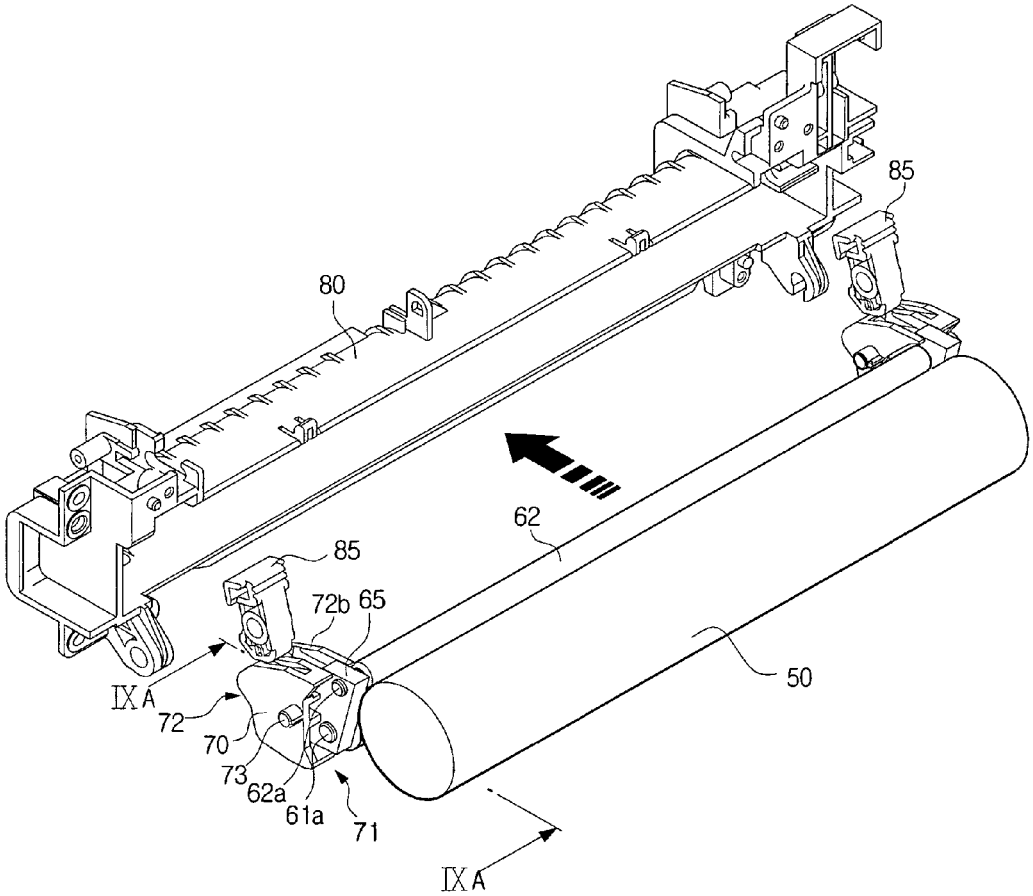
Figure 9A:
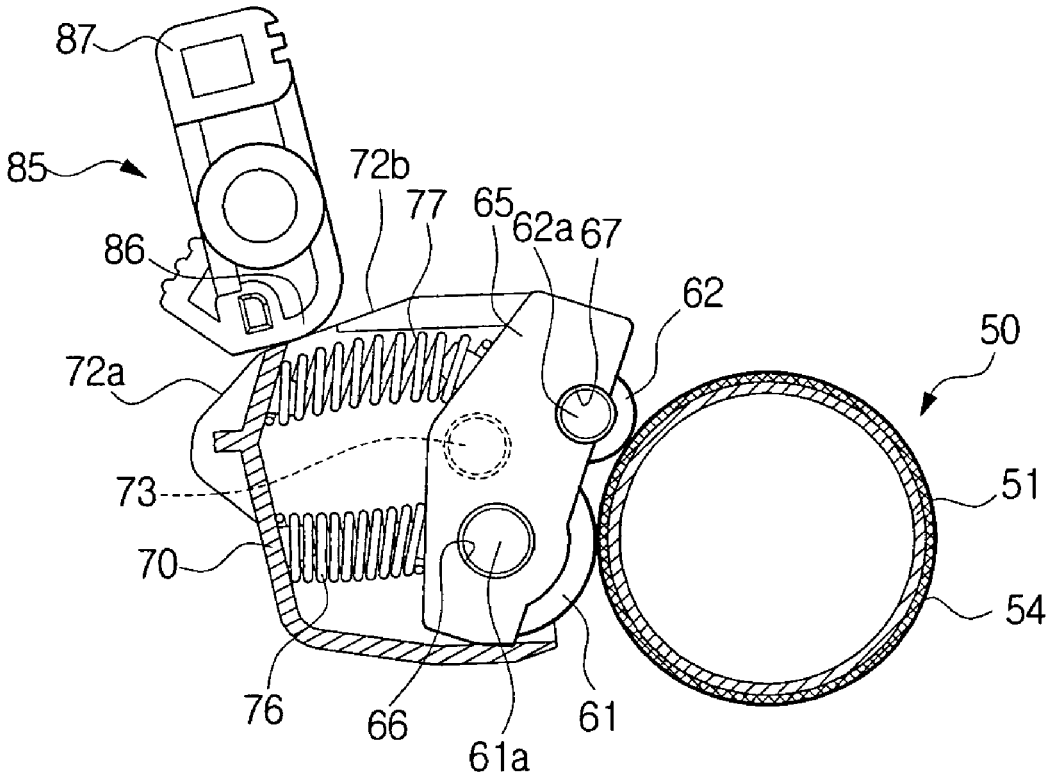
Figure 10:
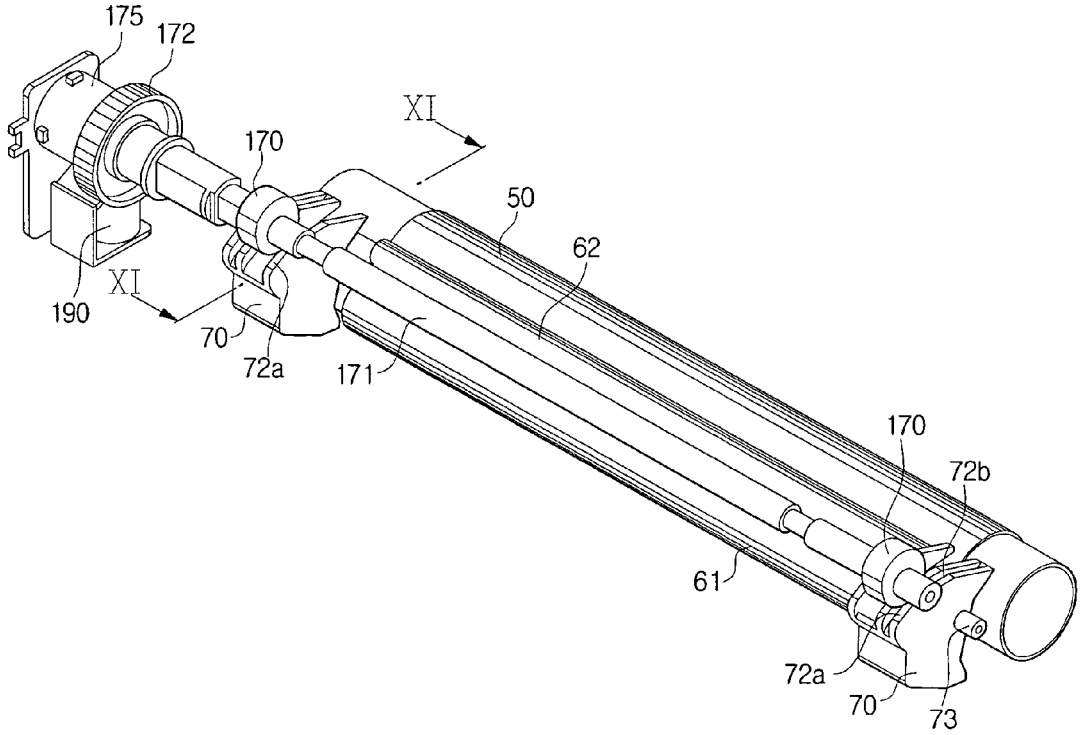
FIGS. 10, 11 and 11A to 11C are perspective and elevational views of the image fixing apparatus according to the third exemplary embodiment of the present invention.

FIGS. 8 to 9A show another exemplary embodiment of the present invention.

The present exemplary embodiment includes a heat roller 50, first and second pressure rollers 61 and 62, and a lever 85, wherein a user may control the compressive forces of the pressure rollers 61 and 62 by hand.

The heat roller 50 is rotatably supported at the opposite ends thereof by the opposite ends of a fixing frame 80, and rotationally driven at a predetermined velocity by a driving motor or the like. The pressure rollers 61 and 62 are rotationally supported at their opposite ends by a pair of bushing members 65.

Each member 65 has support holes 66 and 67 for rotationally supporting the rotary shafts 61*a* and 62*a* of the first and second pressure rollers 61 and 62, respectively, and each of the support holes 66 and 67 may be further provided with a bearing so as to support the rotary shafts 61*a* and 62*a* in such a manner as to be more smoothly rotated. Each bushing member 65 is resiliently supported within each support member 70 by the first and second compression means 76 and 77.

Each support member 70 has an opening 71 formed through one side thereof, and an adjusting portion 72 formed on the other side, and the adjusting portion 72 has plural adjusting surfaces 72*a* and 72*b* for adjusting the rotating angle of each support member 70. A pair of the support members 70 may be integrally formed.

Each support member 70 and each bushing member 65 have plural mounting projections 65a, 65b, 70a and 70b, respectively, on the areas opposite to each other. The opposite ends of the first and second compression portions 76 and 77, each of which are formed of one or more springs, are fitted on the mounting projections 65*a*, 65*b*, 70*a*, and 70*b*, whereby the support member 70 and bushing member 65 receive elastic force.

The first adjusting surface 72*a* serves to control the support members 70 in such a manner that the compressive forces of the reference position of FIG. 2, for example, of the first and second compression portions 76 and 77, are substantially equal to each other.

The second adjusting surface 72*b* serves to control the corresponding support members 70 in such a manner that the compressive force of the first compression portion 76 is to be larger than the compressive force of the second compression portion 77.

Although the position where the compressive forces of the compression portions 76 and 77 are substantially equal to each other is referred to as the reference position in the present exemplary embodiment, a position where the compressive forces of the respective compression means are different from each other may be set as the reference position.

Each support member 70 is pivotally installed in relation to the fixing frame 80.

More specifically, from the opposite sides of the support members 70, pivot projections 73 are protruded outwardly, wherein each pivot projection is received in and rotatably supported by a receiving hole (not shown) of the fixing frame, so that the support members 70 may be relatively pivoted in relation to the fixing frame 80. The pair of the support members 70 may be integrally formed or the pivot projections 73 may be formed as a single one-piece shaft.

The levers 85 are rotatably mounted on the fixing frame 80, wherein one side of each lever 85 is formed with a compression surface 86 and the other side is formed with a gripping part 87.

The compression surfaces 86 of the levers 85 contacts the adjusting portion 72 of the supporting members 70, and depending on the rotating range of the levers 85, the compression surfaces 86 selectively contacts the first and second adjusting surfaces 72*a* and 72*b* of the support members 70.

Figure 8A:
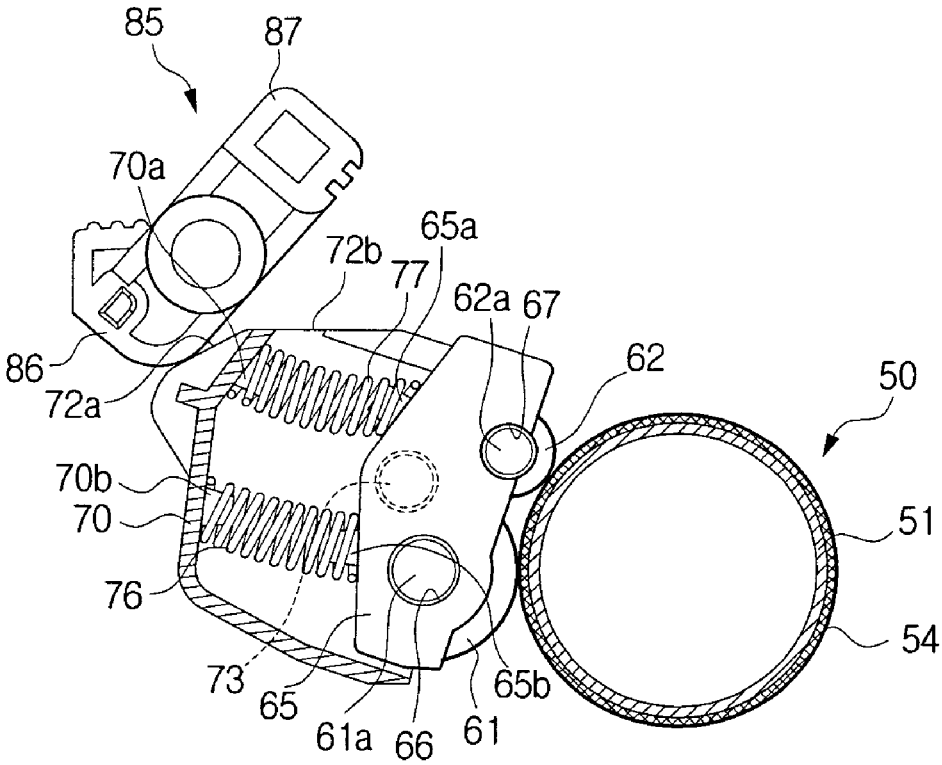

Referring to FIG. 8A, when the levers 85 rotate so that the compression surfaces 86 of the levers 85 contact the first adjusting surfaces 72*a*, the compression surfaces 86 and the first adjusting surfaces 72*a* are fixed in the contact surface by the contact pressure between them. As a result, the first and second compression portions 76 and 77 are substantially equally or similarly compressed, whereby the compressive forces of the first and second pressure rollers 61 and 62 are substantially equal to or similar to each other, and thus the reverse curl is easily produced even when an image fixing operation is implemented for an ordinary paper or a thick paper. Consequently, the paper is discharged in a flattened state and the wrap jam phenomenon or the like is substantially prevented.

Referring to FIG. 9A, when a lever 85 rotates so that the compression surface 86 of the lever 85 contacts the second adjusting surface 72*b*, the compression surface 86 and the second adjusting surface 72*b* are maintained in the contacted state by the contact forces between them. The first compression portion 76 is compressed so that the compressive force of the first compression portion 76 is increased and the second compression portion 77 is relatively elongated so that its compressive force is reduced. Consequently, as the compressive force of the second pressure roller 62 is relatively reduced, a thin paper or an envelope is prevented from being easily crumpled or wrinkled between the heat roller 50 and the second pressure roller 62 during the image fixing operation.

As described above, the exemplary embodiments shown in FIGS. 8 and 9 are configured in such a manner that the pivot angle of support member 77 is adjusted by manually controllable actuators, such as the levers 85. Although it has been described and shown that the each support member 70 has two adjusting surfaces 72*a* and 72*b*, the present invention is not limited to such a configuration and each support member 70 may be provided with more than two sub control surfaces, so that the pivot angle of the support member 70 may be more variously adjusted.

FIGS. 10 to 13 show another exemplary embodiment of the present invention, which is configured in such a way that the compressive forces of the pressure rollers may be adjusted by an actuator using control means 300.

The present exemplary embodiment includes a heat roller 50, first and second pressure rollers 61, 62, and one or more cam members 170.

The cam members 170 are fixedly mounted on the cam shaft 171 in such a manner as to be integrally rotated with the cam shaft 171, and by the rotation of the cam members 170, the peripheral surfaces of the cam members 170 selectively come into contact with the first and second adjusting surfaces 72*a* and 72*b* of the support members 70. A driving gear 172 is separably connected to one end of the cam shaft 171 by a clutch 175, which has control projections 181, 182, 183 and 184 arranged on the peripheral surface of the clutch 175 to be circumferentially spaced from each other.

The driving gear 172 is located outside of the fixing frame, wherein the driving gear 172 is connected with a separate driving source (not shown) adapted to drive the heat roller through a gear train (not shown) or the like, thereby being rotated.

Figure 13:
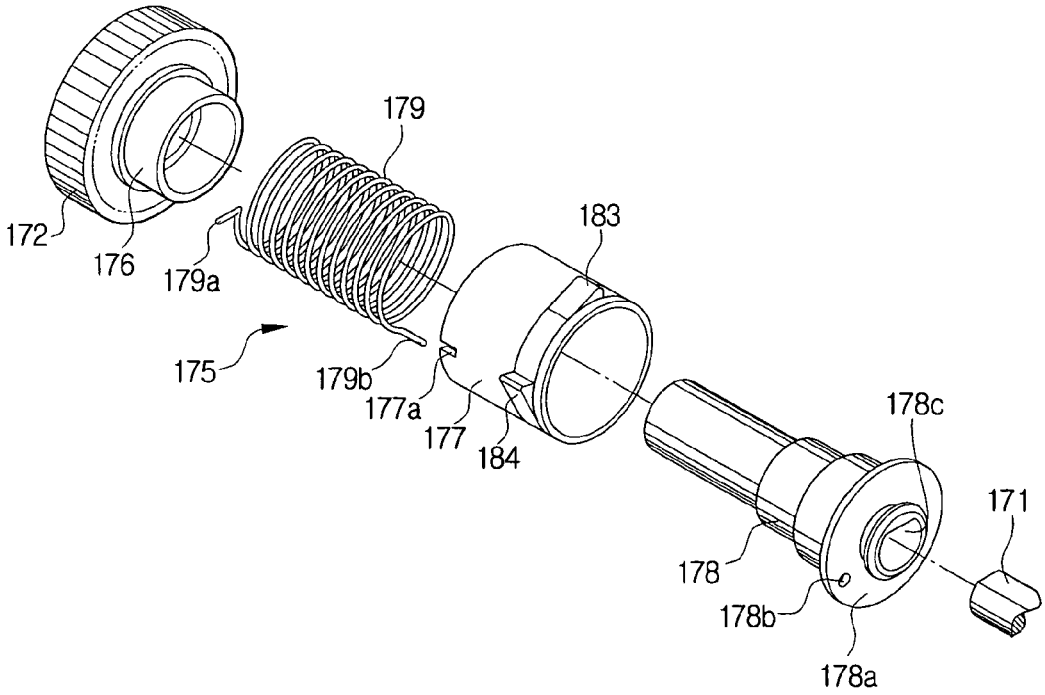
FIG. 13 is an exploded perspective view of a clutch according to an exemplary embodiment of the present invention.

The clutch 175, as shown in FIG. 13, includes a first hub 176 integrally formed on a side of the driving gear 172, a cylindrical clutch body 177 rotatably fitted on the peripheral surface of the first hub 176, a second hub 178 fixedly joined with a side of the clutch body 177, and a clutch spring 179 in a form of a coil spring, which is disposed between the first and second hubs 176 and 177. The peripheral surface of the clutch body 177 is provided with a reference projection 181 and control projections 182, 183 and 184, which are circumferentially spaced from each other.

The clutch spring 179 has a first end 179*a* fixed to a spring fixing slit 177*a*, and a second end 179*b* fixed to a spring fixing hole 178*b* formed through the flange 178*a* of the second hub 178.

With this construction, when the clutch spring 179 is wound on the peripheral surfaces of the first and second hubs 176 and 178, the driving gear 172 and the cam shaft 171 are connected with each other in such a manner as to be rotated in the same direction, and when external forces are applied to the clutch body 177 and the second hub 178 so that the clutch spring 179 is unwound from the peripheral surface of the first and second hubs 176 and 178, the connection between the driving gear 172 and the cam shaft 171 is released.

The flange 178*a* of the second hub 178 is formed with a fixing hole 178c at the core part of the flange 178*a*, wherein the fixing hole 178*c* is extended in the axial direction of the flange 178*a* and the cam shaft 171 is received by the fixing hole 178*c*.

With this construction, when the driving gear 172 and the cam shaft 171 rotate in one direction, the clutch 175 interconnects the driving gear 172 and the cam shaft 171 by the winding action of the clutch spring 179. When the driving gear 172 and the cam shaft 172 do not rotate in the same direction, the clutch 175 releases the connection between the driving gear 172 and the cam shaft 171.

Figure 12:
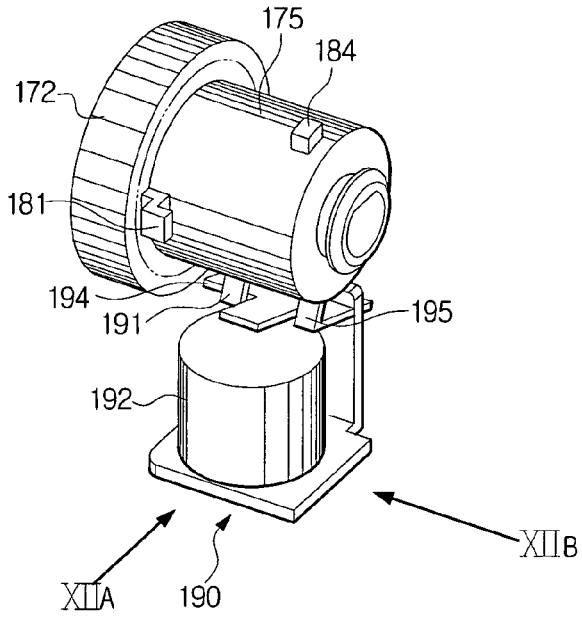
FIG. 12 is a perspective view of a solenoid and a clutch.
Figure 12A:
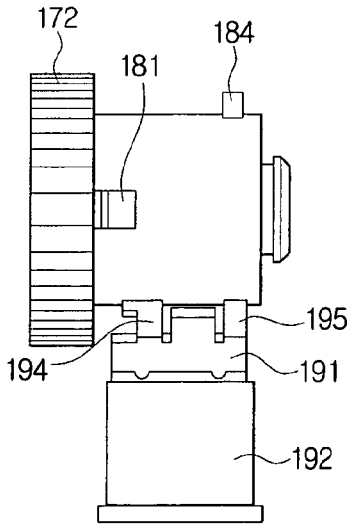
FIG. 12A is a front elevational view of the solenoid and clutch, which is viewed in the direction indicated by arrow XIIa of FIG. 12.
Figure 12B:
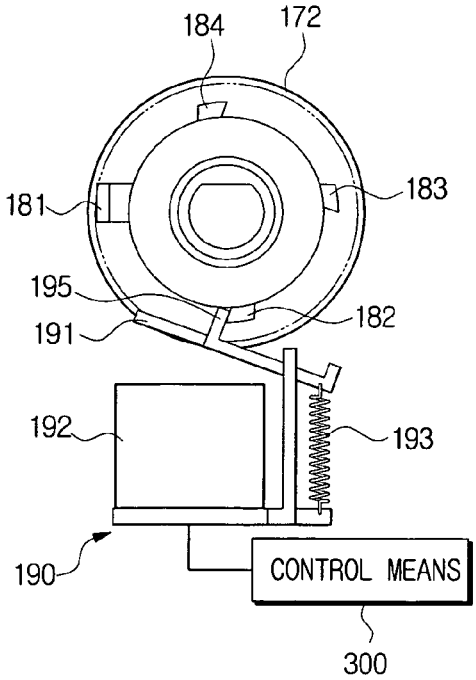
FIG. 12B is a side elevational view of the solenoid and clutch, which is viewed in the direction indicated by arrow XIIb of FIG. 12.

A solenoid 190 is installed outside of the clutch 175, wherein the solenoid 190 is a kind of a conventional solenoid in which a movable body 191, such as an armature or a plunger, performs rectilinear movement or swivel movement. The solenoid 190 shown in FIGS. 12 to 12E is arranged in such a way that when power is supplied to the solenoid 190, the movable body 191, in the form of an armature, is drawn to an electromagnet 192 of the solenoid 190, thereby being positioned in a substantially horizontal state. When the supply of power to the solenoid 190 is interrupted, the movable body 191 is swiveled outwardly by the spring 193, thereby being positioned in a tilted state.

The movable body 191 of the solenoid 190 has first and second latch projections 194 and 195 at its free end. When power is supplied to the solenoid 190, the first latch projection 194 is engaged with the reference projection 181, thereby stopping the rotation of the clutch body 177. When the supply of power to the solenoid 190 is interrupted, the second latch projection 195 is selectively engaged with first to third control projections 182, 183 and 184, thereby stopping the rotation of the clutch body 177.

The first latch projection 194 has a bent cross-section, and the reference projection 181 on the clutch boy 177 also has a bent cross-section to correspond to the first latch projection 194. With this arrangement of the first latch projection 194 and the reference projection 181, when power is supplied to the solenoid 190, the first latch projection 194 is engaged with the reference projection 181. When the supply of power to the solenoid 190 is interrupted, the first latch projection 194 passes the reference projection 181.

When the rotation of the clutch 175 or the clutch body 177 is stopped as described above, the rotation of the cam shaft 171, which is integrally connected to the clutch body 177, is also stopped, and the clutch spring 179 is unwound from the peripheral surfaces of the first and second hubs 176 and 178, whereby the connection between the driving gear 172 and the cam shaft 171 is released.

The solenoid 190 is electrically connected with the control means 130 as shown in FIGS. 12B to 12E, and the control means 300 controls the operation of the solenoid 190.

Preferably, the control means 300 is connected to a control board of an image forming apparatus or a PC, so that when a user properly selects one or more parameters (thickness, size, quality of material and the like) of a record medium and/or the density of a toner image on the control board or the PC, the control means 300 controls the actuator 100 on the basis of the selected information.

Alternatively, the control means 300 may be connected to a detection sensor (not shown) for detecting the parameters (thickness, size, quality of material and the like) of the record medium, so that the control means 300 controls the actuator 100 on the basis of the detection signals of the detection sensor.

Additionally, the control means 300 may be connected to a detection sensor (not shown) for detecting the density of a toner image, so that the control means 300 controls the actuator 100 on the basis of the detection signals of the detection sensor.

When the driving gear 172 is rotationally driven by an external driving source (not shown), the cam shaft 171, which is connected with the driving gear 172 through the clutch 175, is rotated in unison. When the movable body 191 of the solenoid 190 is operated by the control means 300 while the cam shaft 171 is rotating as described above and selectively engaged with the reference projection 181 and the control projections 182, 183 and 184, the rotational driving of the clutch 175 is stopped, as a result of which the connection between the driving gear 172 and the cam shaft 171 is released by the clutch 175, thereby stopping the rotational movement of the cam shaft 171. When the rotation of the cam shaft 171 is stopped, the rotation of the cam members 170 is also stopped and the state in which the cam members 170 are selectively in contact with the first and second adjusting surfaces 72*a* and 72*b* of the support members 70, is maintained.

FIGS. 11 and 11A to 11C show the operation according to the present exemplary embodiment.

When power is supplied to the solenoid 190, the movable body 191 of the solenoid 190 is drawn toward the core 192, as shown in FIG. 12E. When the first latch projection 194 of the movable body 191 is engaged with the reference projection 181 of the clutch body 177, the clutch body 177, which has been connected from the driving gear 172 through the clutch spring 179, stops rotating.

When the first latch projection 194 of the movable body 191 is engaged with the reference projection 181, the cam member 170 contacts the boundary between the first and second adjusting surfaces 72*a* and 72*b* of the corresponding support member 70, wherein this condition corresponds to a "home position mode."

Then, when the supply of power to the solenoid 190 is interrupted, the movable body 192 of the solenoid 90 is swiveled outwardly, thereby being positioned in the tilted state, and the first latch projection 194 of the movable body 191 passes the space defined by the bent reference projection of the clutch body 177, thereby removing the external forces applied to the clutch body, so that the clutch body 177 is connected again to the driving gear 172 and thus rotationally driven.

Figure 11:
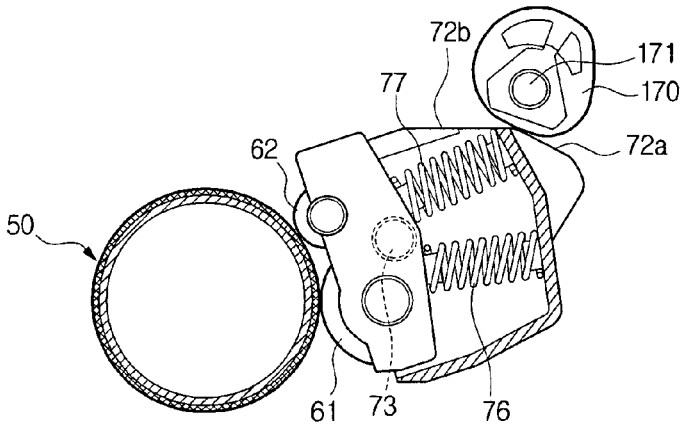

When the supply of power to the solenoid 190 is interrupted as described above, the movable body 191 approaches or contacts the peripheral surface of the clutch body 177 in the tilted state. When the second latch projection 195 of the movable body 191 is engaged with the first control projection 182 of the clutch body 177 as shown in FIG. 12B, the clutch 177, which has been connected with the driving gear 172 through the clutch spring 179, stops rotating, and the cam member 170 contacts the first adjusting surface 72*a* of the support member 70 as shown in FIG. 11, wherein this state corresponds to a "plain mode." In this state, the compressive forces of the first and second compression portions 76 and 77 are substantially similar, whereby an image fixing operation for an ordinary paper or a thick paper is performed.

When power is temporarily supplied to the solenoid 190 again, the movable body 191 is drawn toward the core and laid in the horizontal state, and the second latch projection 195 of the movable body 191 is disengaged from the first adjust projection 182 of the clutch body 177, whereby the clutch body 177 rotates clockwise again.

Figure 11A:
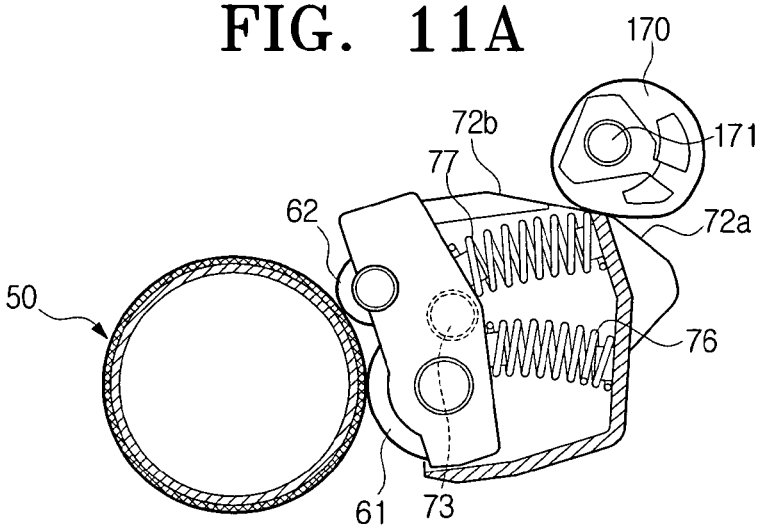
Figure 12C:
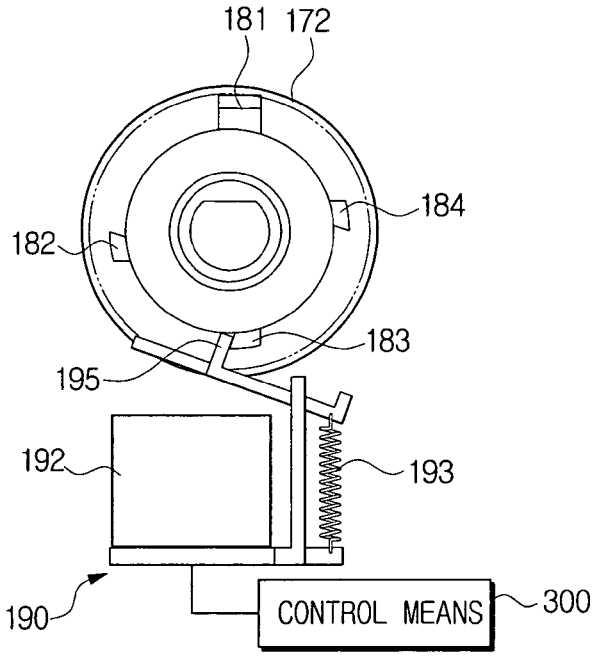
FIGS. 12C to 12E are side elevational views of the step-by-step operating states of a solenoid and a clutch according to an exemplary embodiment of the present invention.
Figure 12D:
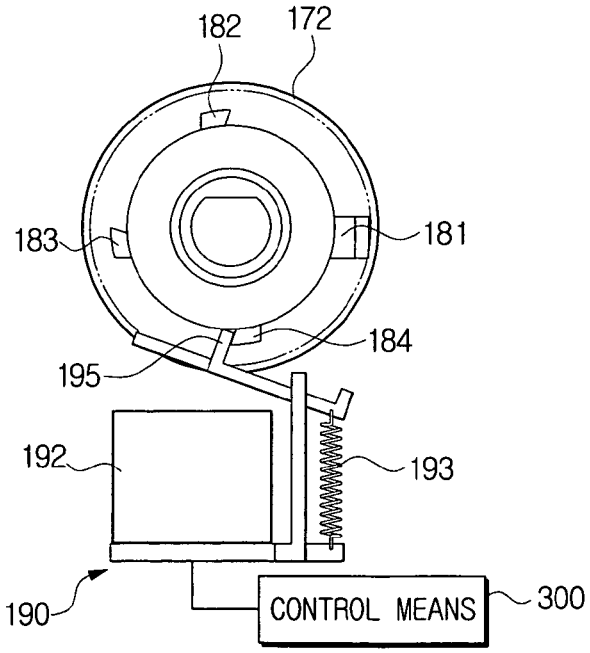
Figure 12E:
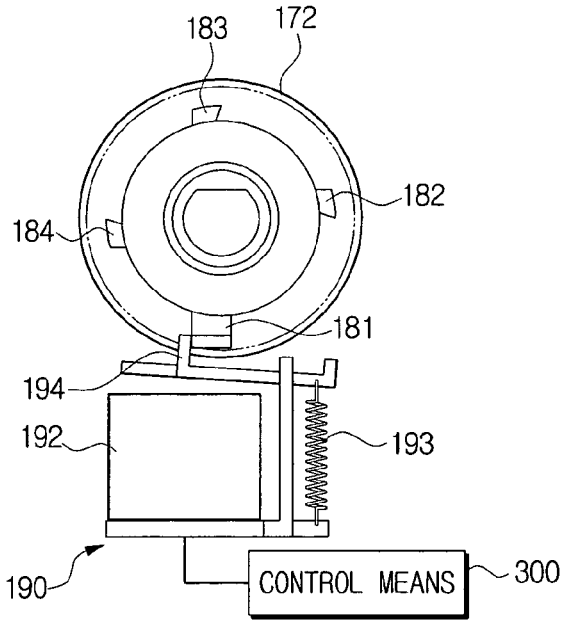

Then, when the supply of power to the solenoid 190 is interrupted, the movable body 191 returns to the tilted state, and as shown in FIG. 12C, the second latch projection 195 of the movable body 191 is engaged with the second control projection 183. In this position, the clutch body 177, which has been connected with the driving gear 172 through the clutch spring 179, stops rotating, and the cam member 170 contacts the second adjusting surface 72*b* of the support member 70 as shown in FIG. 11A,which corresponds to a "thin mode." In this position, the compressive force of the first compression portion 76 is increased as compared to the compressive force of the second compression portion 77, whereby the compressive force of the first pressure roller 61 is higher than that of the second pressure roller 62, so that an image fixing process for a thin record medium is performed.

When power is temporarily supplied to the solenoid again, the movable body 191 is drawn toward the core 192, thereby being positioned in the substantially horizontal position, and the second latch projection 195 of the movable body 191 is disengaged from the second control projection 183 of the clutch body 177, whereby the clutch body 177 rotates clockwise again.

Figure 11B:
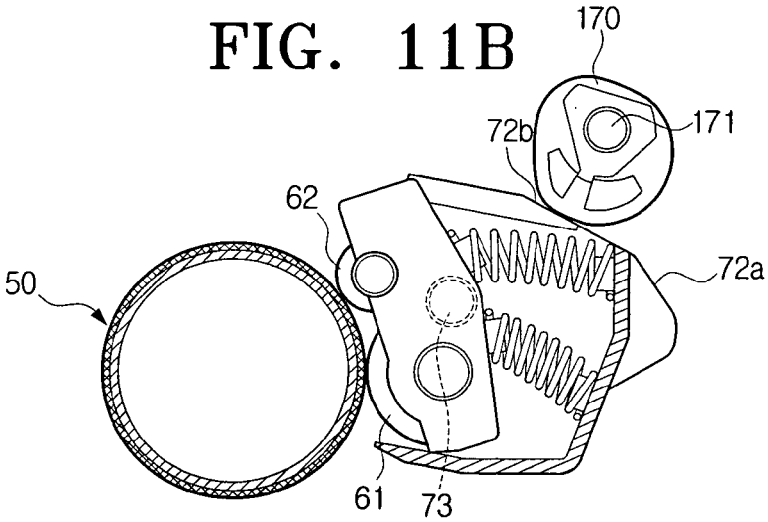
Figure 11C:
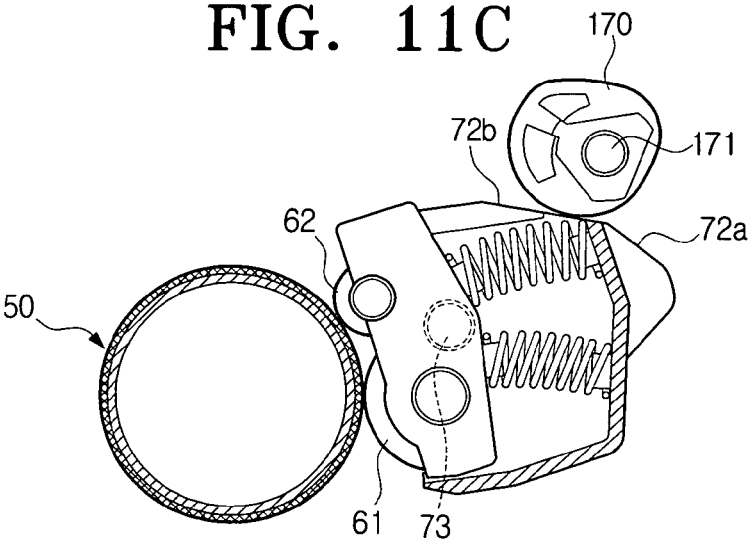

Then, when the supply of power to the solenoid 190 is interrupted, the movable body 191 is in the tilted position, whereby the second latch projection 195 of the movable body 191 is engaged with the third control projection 184 of the clutch body 177. In this position, the clutch body 177, which has been connected with the driving gear 172 through the clutch spring 179, stops rotating, and the cam member 170 contacts the outer surface of the second sub control surface 72*b* of the support member 70 as shown in FIG. 11B, wherein this position corresponds to an "envelope mode." In this position, the compressive force of the first compression means 76 is further increased as compared with the above-mentioned thin mode, whereby the compressive force of the first pressure roller 61 is higher than the compressive force of the second compression roller 62, whereby an image fixing process for a record medium, such as an envelope, which is folded one or more times, is performed.

Because the other remaining constructions and operations are substantially similar to the exemplary embodiments shown in FIGS. 8 to 9A and described above, a detailed description thereof is omitted.

Figure 14:
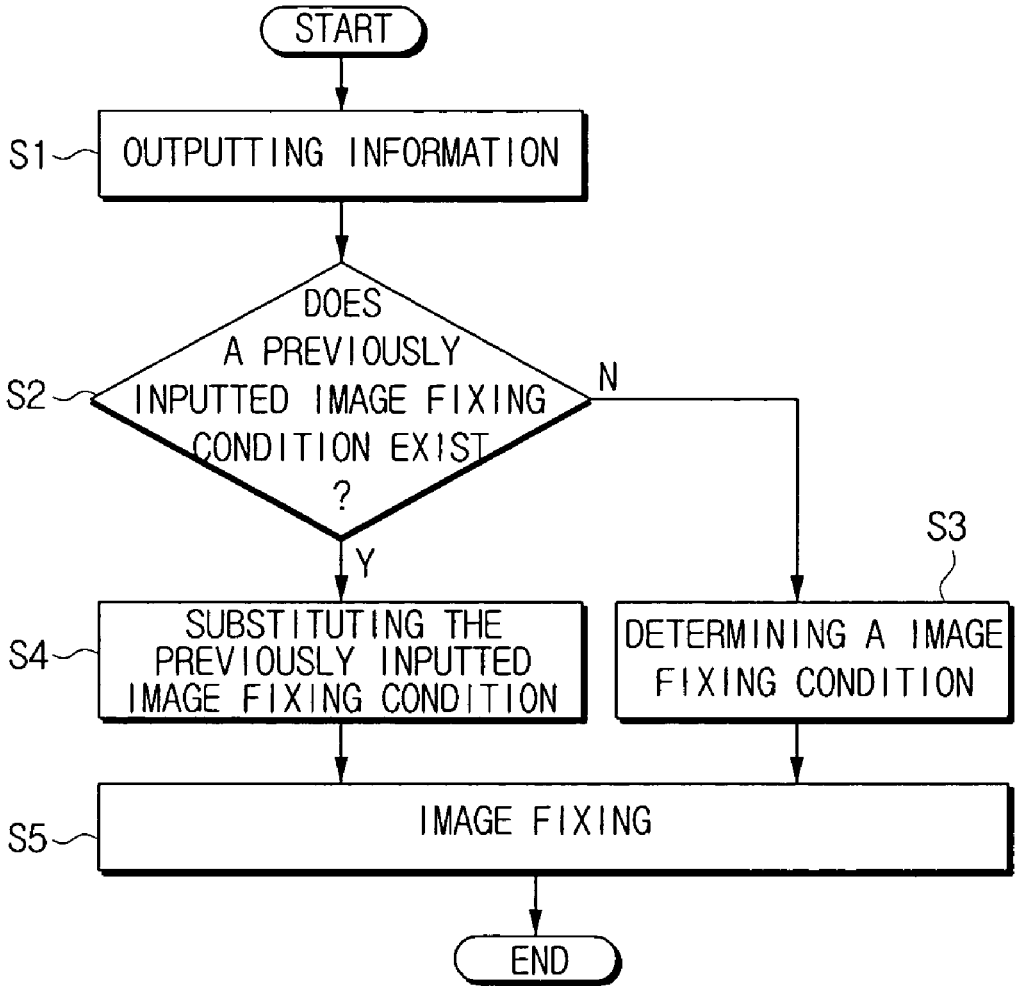
FIG. 14 is a flowchart of the method of controlling an image fixing device according to an exemplary embodiment of the present invention.

FIG. 14 is a flowchart showing how the inventive image fixing apparatus is controlled.

The parameters of a record medium and/or the density of toner image are detected by a detection sensor or outputted by selected signals of a user inputted to the control means 300 (S1). Then, it is determined whether a fixing condition, which has been previously inputted to a memory of the control means 300 (that is, that corresponds to a fixing condition for a previously performed fixing operation) exists or not (S2). The fixing condition is determined on the basis of the information determined in the step S1 unless an inputted image fixing condition exists (S3). The image fixing operation is performed after adjusting the total sum and/or relative ratio of the compressive forces to be applied to the plural pressure rollers 61 and 62 according to the image fixing condition determined in the step S3 (S5).

Additionally, when a previously inputted image fixing condition exists, an image fixing condition is newly determined on the basis of the information outputted in the step S1 and the newly determined image fixing condition is substituted for the previously inputted image fixing condition (S4). The image fixing operation is performed after adjusting the total sum and/or relative ratio of the compressive forces to be applied to the plural pressure rollers 61 and 62 according to the substituted image fixing condition (S5).

The process for adjusting the total sum and/or relative ratio of the compressive forces according to the image fixing condition in the step S5 may be performed in such a manner of moving or pivoting the support members 70 or moving or pivoting the bushing members 65 as described above in terms of the image fixing apparatuses of the first to sixth exemplary embodiments.

Additionally, the previously inputted image fixing condition may be that used in an image fixing operation performed prior to the presently performed image fixing operation or one or more reference values inputted to the memory of the control means 300.

According to exemplary embodiments of the present invention, the fixability of a toner image is improved by adjusting the compressive forces of pressure rollers according to the thickness, size and quality of material of a record paper or the density of a toner image.

Addition, according to exemplary embodiments of the present invention, the curl and/or wrap jam of a record medium, which may be produced when a toner image is fixed, may be efficiently prevented, while the fixability of the toner image is improved.

Although representative embodiments of the present invention have been shown and described in order to exemplify the principle of the present invention, the present invention is not limited to the specific embodiments. It will be understood that various modifications and changes may be made by one skilled in the art without departing from the spirit and scope of the invention as defined by the appended claims. Therefore, it shall be considered that such modifications, changes and equivalents thereof are all included within the scope of the present invention.

What is claimed is:

1. An image fixing apparatus, comprising:

a heat roller;

a plurality of pressure rollers that rotationally contact and apply pressure to the surface of the heat roller at the same time; and a compression unit for compressing the plurality of pressure rollers against the heat roller, wherein the compressive forces for compressing the plural pressure rollers are adjustable according to one or more parameters of a record medium and/or density of a toner image while the plurality of pressure rollers maintain contact with the heat roller, wherein the compression unit includes a compression portion for compressing the plurality of pressure rollers; and a support member for supporting the compression portion.

2. An image fixing apparatus as claimed in claim 1, wherein the compression unit includes at least one bushing member for rotatably supporting the plurality of pressure rollers.

3. An image fixing apparatus as claimed in claim 2, wherein the compression unit includes an actuator for driving at least one of the bushing member and the support member.

4. An image fixing apparatus as claimed in claim 3, wherein the actuator is manually controlled.

5. An image fixing apparatus as claimed in claim 4, wherein the actuator is selected from the group consisting of a lever mechanism, a cam mechanism, and a gear transmission mechanism.

6. An image fixing apparatus as claimed in claim 3, wherein the actuator is electronically controlled using control means.

7. An image fixing apparatus as claimed in claim 6, wherein the actuator is selected from the group consisting of a cam mechanism, a solenoid, a gear transmission mechanism, a link mechanism, and a combination thereof.

8. An image fixing apparatus as claimed in claim 6, wherein the actuator is provided in such a manner as to cooperate with a driving unit, and the driving unit includes a driving shaft separably connected to the actuator;

a plurality of phase control projections formed on the peripheral surface of the driving shaft; and a solenoid arranged outside of the driving shaft to control the plurality of phase control projections.

9. An image fixing apparatus as claimed in claim 6, wherein the control means is inputted with one or more parameters of a record medium and operated according to the parameters.

10. An image fixing apparatus as claimed in claim 6, wherein the control means is connected to a paper detection sensor for detecting one or more parameters of a paper and/or a density detection sensor for detecting density of a toner image.

11. An image fixing apparatus as claimed in claim 2, wherein the bushing member is provided in such a manner as to be pivotable about a pivot point of the bushing member.

12. An image fixing apparatus as claimed in claim 2, wherein the support member is provided in such a manner as to be movable about a pivot point of the bushing member.

13. An image fixing apparatus as claimed in claim 12, wherein the support member is guided along a guide path.

14. An image fixing apparatus as claimed in claim 2, wherein the support member is pivotally and movably provided so that a distance between the heat roller and the support member is adjustable.

15. An image fixing apparatus as claimed in claim 14, wherein the support member is guided along a guide path.

16. An image fixing apparatus as claimed in claim 1, wherein the compression unit includes an actuator for driving the support member.

17. An image fixing apparatus as claimed in claim 16, wherein the actuator is manually controlled.

18. An image fixing apparatus as claimed in claim 17, wherein the actuator is selected from the group consisting of a lever mechanism, a cam mechanism, and a gear transmission mechanism.

19. An image fixing apparatus as claimed in claim 16, wherein the actuator is electronically controlled using control means.

20. An image fixing apparatus as claimed in claim 19, wherein the actuator is selected from the group consisting of a cam mechanism, a solenoid, a gear transmission mechanism, a link mechanism, and any combination thereof.

21. An image fixing apparatus as claimed in claim 19, wherein the actuator is provided in such a manner as to cooperate with a driving unit, and the driving unit includes a driving shaft separably connected to the actuator;

a plurality of phase control projections formed on the peripheral surface of the driving shaft; and a solenoid arranged outside of the driving shaft to control the plurality of phase control projections.

22. An image fixing apparatus as claimed in claim 19, wherein the control means is inputted with one or more parameters of a record medium and operated according to the parameters.

23. An image fixing apparatus as claimed in claim 19, wherein the control means is connected to a paper detection sensor for detecting one or more parameters of a paper and/or a density detection sensor for detecting density of a toner image.

24. An image fixing apparatus as claimed in claim 1, wherein the compressive forces applied by the compression portion are evenly distributed over the plurality of pressure rollers.

25. An image fixing apparatus as claimed in claim 24, wherein the compression portion includes at least one spring for applying compressive force to the plurality of pressure rollers.

26. An image fixing apparatus as claimed in claim 1, wherein a plurality of compression portions correspond to the plurality of pressure rollers.

27. An image fixing apparatus as claimed in claim 26, wherein each of the plurality of compression portions is provided to a respective one of the plurality of pressure rollers.

28. An image fixing apparatus as claimed in claim 26, wherein each of the plurality of compression portions has at least one spring.

29. An image fixing apparatus as claimed in claim 26, wherein each of the plurality of compression portions has a different elastic coefficient.

30. An image fixing apparatus as claimed in claim 26, wherein each of the plurality of compression portions has a different length.

31. An image fixing apparatus as claimed in claim 1, wherein the support member is movably provided so that a distance between the heat roller and the support member is adjustable.

32. An image fixing apparatus as claimed in claim 31, wherein the support member is guided along a guide path.

33. An image fixing apparatus as claimed in claim 1, wherein the support member is provided in such a manner as to be pivotable about a pivot point of the support member.

34. An image fixing apparatus, comprising:

a heat roller having a heat source disposed therein;

a plurality of pressure rollers that rotationally contact and apply pressure to the surface of the heat roller at the same time;

means for adjusting the relative compressive forces of the pressure rollers while the plurality of pressure rollers maintain contact with the heat roller, wherein the compressive force adjusting means includes a bushing member for rotationally supporting the plurality of pressure rollers;

a support member located at a distance from the bushing member; and a compression means resiliently disposed between the bushing member and the support member to resiliently compress the plurality of pressure rollers.

35. An image fixing apparatus as claimed in claim 34, wherein the relative ratio and total sum of the compressive forces respectively applied to the plurality of pressure rollers is adjustable.

36. An image fixing apparatus as claimed in claim 34, wherein the support member is pivotally provided.

37. An image fixing apparatus as claimed in claim 36, wherein pivot means are provided for pivoting the support member.

38. An image fixing apparatus as claimed in claim 37, wherein the pivot means includes a lever that rotationally contacts one side of the support member on which a plurality of control surfaces are formed, and the support member is pivoted by the swivel movement of the lever to adjust the compressive forces of the compression means.

39. An image fixing apparatus as claimed in claim 37, wherein the pivot means includes a cam member that rotationally contacts one side of the support member, and a driving unit for rotating the cam member.

40. An image fixing apparatus as claimed in claim 39, wherein the driving unit includes a clutch for separably connecting a cam shaft of the cam member to a driving source;

a solenoid provided outside of the clutch to adjust a rotating position of the cam shaft; and control means for controlling the operation of the solenoid.

41. An image fixing apparatus as claimed in claim 40, wherein the control means is inputted with one or more parameters of a record medium and operated according to the parameters.

42. An image fixing apparatus as claimed in claim 40, wherein the control means is connected to a paper detection sensor for detecting one or more parameters of a record medium and/or a density detection sensor for detecting density of a toner image.

43. A method of controlling an image fixing apparatus, comprising the step of adjusting compressive forces applied to a plurality of pressure rollers according to one or more parameters of a record medium and/or density of a toner image, wherein the plurality of pressure rollers apply pressure to a heat roller at the same time and a compression unit for compressing the plurality of pressure rollers, the compressive forces being adjustable while the plurality of pressure rollers maintain contact with the heat roller, the compression unit including a compression portion for compressing the plurality of pressure rollers; and a support member for supporting the compression portion.

44. A method of controlling an image fixing apparatus including a heat roller, a plurality of pressure rollers that rotationally contact and apply pressure to the surface of the heat roller at the same time, a compression means for compressing the plurality of pressure rollers against the heat roller, a support member for supporting the compression means, and at least one bushing member for rotationally supporting the plurality of pressure rollers, wherein the method comprises the steps of outputting information of one or more parameters of a record medium and/or density of a toner image;

determining an image fixing condition corresponding to the outputted information; and performing an image fixing operation after adjusting at least one of the total sum or relative ratio of the compressive forces applied to the plurality of pressure rollers according to the determined image fixing condition, the compressive forces being adjustable while the plurality of pressure rollers maintain contact with the heat roller.

45. A method as claimed in claim 44, wherein the image fixing condition determining step further comprises judging whether a previously inputted image fixing condition exists;

determining the image fixing condition on the basis of the information estimated in the information estimating step unless the previously inputted image fixing condition exists; and substituting the image fixing condition newly determined on the basis of the information estimated in the information estimating step for the previously inputted image fixing condition, if the previously inputted image fixing condition exists.

46. A method as claimed in claim 44, wherein the image fixing step further comprises adjusting the relative ratio of the compressive forces applied to the plurality of pressure rollers by pivoting the support member and/or the bushing member.

47. A method as claimed in claim 46, wherein the image fixing step further comprises adjusting the total sum of the compressive forces applied to the plurality of pressure rollers by moving the support member so that the distance between the support member and the heat roller is adjusted.

* * * * *